US012504017B1

(12) United States Patent
Wu et al.

(10) Patent No.: US 12,504,017 B1
(45) Date of Patent: Dec. 23, 2025

(54) FAN

(71) Applicant: ETRONTA LIMITED, Hong Kong (HK)

(72) Inventors: Jinhong Wu, Guangdong (CN); Dewen Zeng, Guangdong (CN)

(73) Assignee: ETRONTA LIMITED, Hong Kong (HK)

( * ) Notice: Subject to any disclaimer, the term of this patent is extended or adjusted under 35 U.S.C. 154(b) by 0 days.

(21) Appl. No.: 19/194,396

(22) Filed: Apr. 30, 2025

(30) Foreign Application Priority Data

Jan. 13, 2025 (CN) ..... 202520074275.3

(51) Int. Cl.

| | |
|---|---|
| ***F04D 25/06*** | (2006.01) |
| ***F04D 19/00*** | (2006.01) |
| ***F04D 29/52*** | (2006.01) |
| ***F04D 29/64*** | (2006.01) |

(52) U.S. Cl.
CPC ..... *F04D 25/0673* (2013.01); *F04D 19/002* (2013.01); *F04D 29/522* (2013.01); *F04D 29/646* (2013.01)

(58) Field of Classification Search
CPC .. F04D 19/002; F04D 25/0673; F04D 29/522; F04D 29/646
USPC ..... 248/690, 692, 304, 303, 301, 339, 127, 248/158, 163.1, 431, 432, 16, 5, 166, 248/168, 169, 170, 171, 176.1, 187.1
See application file for complete search history.

(56) References Cited

U.S. PATENT DOCUMENTS 8,272,605 B2 * 9/2012 Fuchs ..... F16B 7/1454 248/156

FOREIGN PATENT DOCUMENTS

| | | | | |
|---|---|---|---|---|
| CN | 201129314 Y | * | 10/2008 | |
| CN | 203570617 U | * | 4/2014 | |
| CN | 108691788 A | * | 10/2018 | ..... F04D 25/0673 |
| CN | 105927567 B | * | 9/2019 | ..... F04D 29/646 |
| CN | 215445838 U | * | 1/2022 | |
| CN | 216407245 U | * | 4/2022 | |
| CN | 217029374 U | * | 7/2022 | |
| DE | 202017007454 U1 | * | 8/2021 | ..... H01M 50/244 |

* cited by examiner

*Primary Examiner* — Essama Omgba
*Assistant Examiner* — Joseph S. Herrmann
(74) *Attorney, Agent, or Firm* — ScienBiziP, P.C.

(57) ABSTRACT

A fan is provided, the fan includes a fan head, a power supply assembly and a floor-standing bracket, the floor-standing bracket is configured to support a combination of the fan head and the power supply assembly on a ground; a power bank is received in the power supply assembly and configured to supply power to the fan head, the power supply assembly is detachably connected to the supporting bracket; when the power supply assembly disengages with the supporting bracket, the bottom surface of the power supply assembly acts as a base to contact with a support surface and supports the fan head on the support surface, and a hook attaches to the power supply assembly configured to suspend the combination of the fan head and the power supply assembly.

18 Claims, 20 Drawing Sheets

FAN

RELATED APPLICATIONS

This application claims the benefit of priority to Chinese Patent Application Number 202520074275.3 filed on Jan. 13, 2025, in the China National Intellectual Property Administration. The entire contents of the above-identified application are hereby incorporated by reference.

TECHNICAL FIELD

The present disclosure relates to the technical field of household fixtures, and in particular, to a fan.

BACKGROUND

During outdoor camping in summer, environmental constraints often give rise to issues such as high temperatures, humidity, and stuffiness. Fans may help alleviate or resolve these problems. However, most fans have stringent requirements for their operating environment, usually being limited to being placed on flat ground or low-lying flat desktops.

BRIEF DESCRIPTION OF DRAWINGS

In order to illustrate the technical solution in embodiments of the present invention more clearly, the following briefly introduces accompanying drawings used in the description of the embodiments. Obviously, the accompanying drawings in the following description are only some embodiments of the present invention. Those of ordinary skill in the art can obtain other accompanying drawings from these accompanying drawings without any creative efforts.

DETAILED DESCRIPTION

Reference will now be made in detail to representative embodiments illustrated in the accompanying drawings. It should be understood that the following descriptions are not intended to limit the embodiments to one preferred implementation. To the contrary, the described embodiments are intended to cover alternatives, modifications, and equivalents as can be included within the spirit and scope of the disclosure and as defined by the appended claims.

Figure 1:
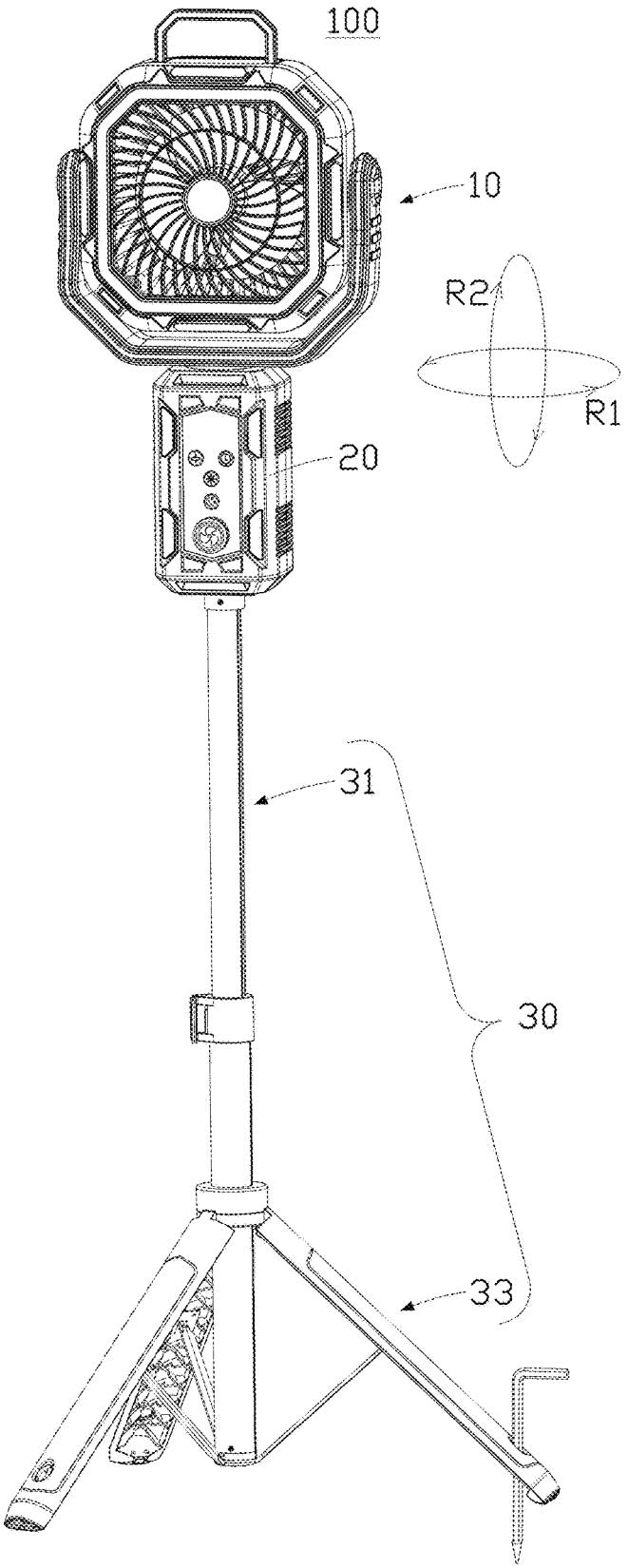
FIG. 1 is a perspective view of a fan according to a first embodiment of the present disclosure.

Refer to FIG. 1, a fan 100 of the first embodiment of the present disclosure is shown. The fan 100 comprises a fan head 10, a power supply assembly 20, and a supporting bracket 30. The fan head 10 is disposed at one end of the power supply assembly 20, and the supporting bracket 30 is detachably connected to the other end of the power supply assembly 20. The fan head 10 is raised up and supported by the supporting bracket 30, so that the fan 100 is capable of standing upright on a first support surface. In this embodiment, the first support surface is ground. When the supporting bracket 30 disengages from the power supply assembly 20, the power supply assembly 20 acts as a base, which makes the fan head 10 to stand stably on a second support surface. In this embodiment, the second support surface can be for example a desktop surface.

Refer to FIGS. 2 to 5, the fan head 10 includes a frame 11 and a fan body 12. The frame 11 is rotatably connected to an end of the power supply assembly 20, thereby making the frame 11 to rotate relative to the power supply assembly 20 in a first direction R1, which is defined as either a clockwise or counterclockwise direction within a horizontal plane. Two opposite sides of the fan body 12 are rotatably connected to the frame 11, thereby making the fan body 12 to rotate relative to the frame 11 along a second direction R2, which is perpendicular to the first direction R1.

Figure 3:
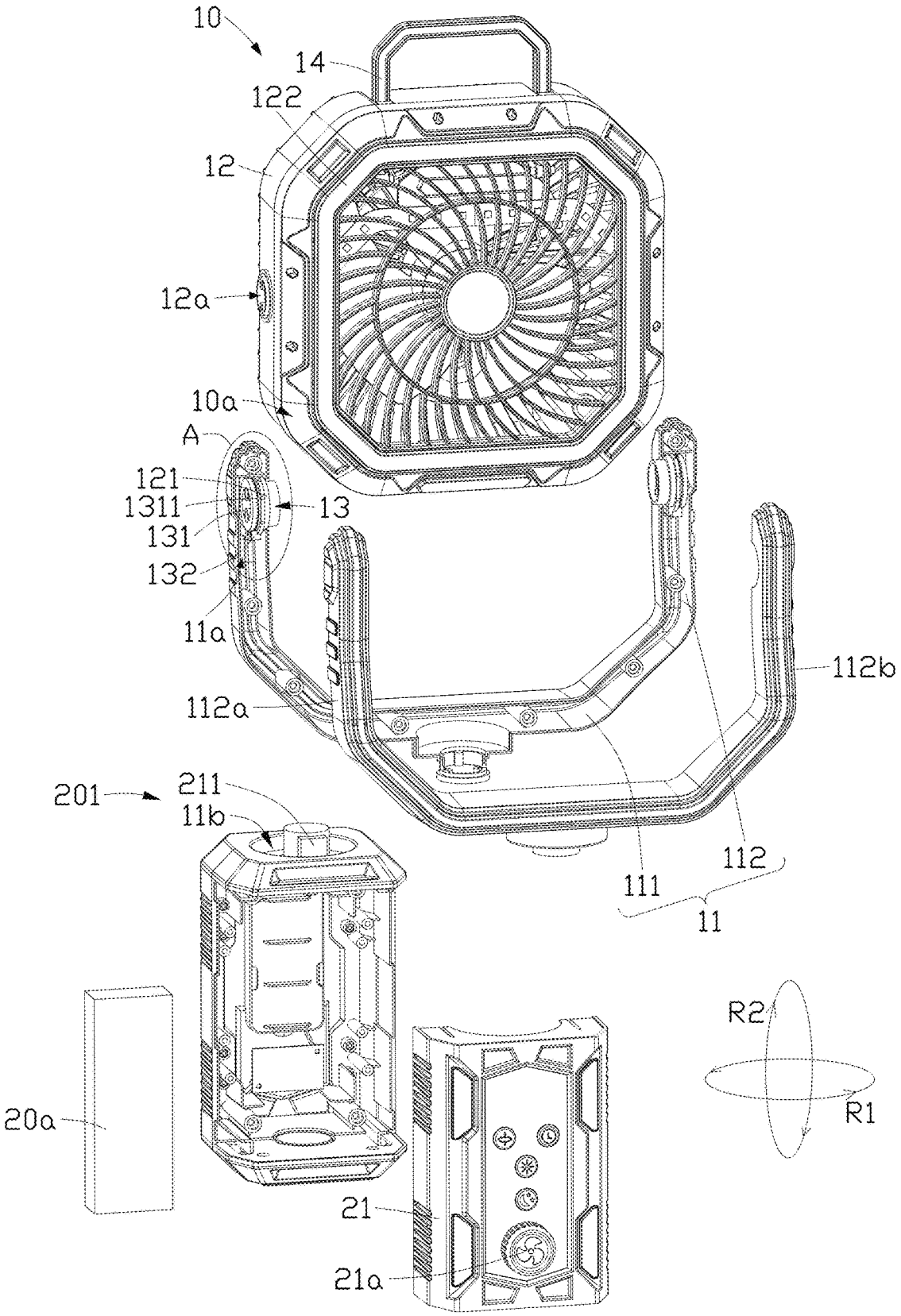
FIG. 3 presents an exploded view of a top part of the fan as shown in FIG. 1, with a supporting bracket omitted.
Figure 4:
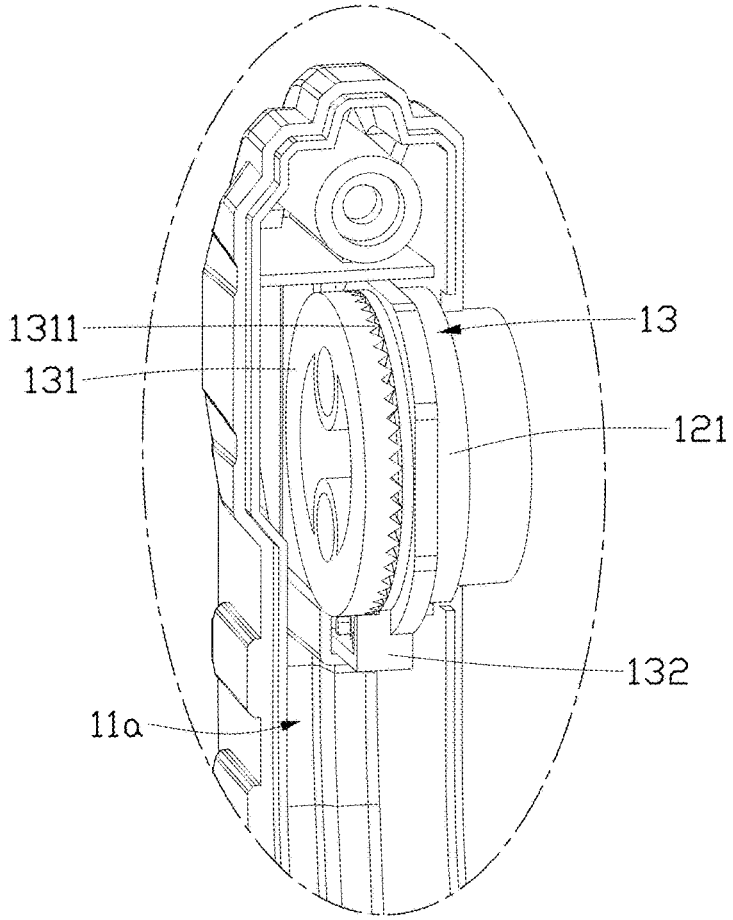
FIG. 4 is an enlarged schematic diagram of region A in FIG. 3.

Refer also to FIG. 3 and FIG. 4, the frame 11 has a U-shaped structure, and includes a connecting portion 111 and two arms 112*a*, 112*b* respectively connected to two opposite ends (not labeled) of the connecting portion 111. The two arms 112*a* and 112*b* are rotatably connected to the fan body 12. The connecting portion 111 and the two arms 112*a*, 112*b* cooperatively define a receiving space 10*a* to receive the fan body 12, such that the fan body 12 rotates in the receiving space 10*a* along the second direction R2.

Figure 5:
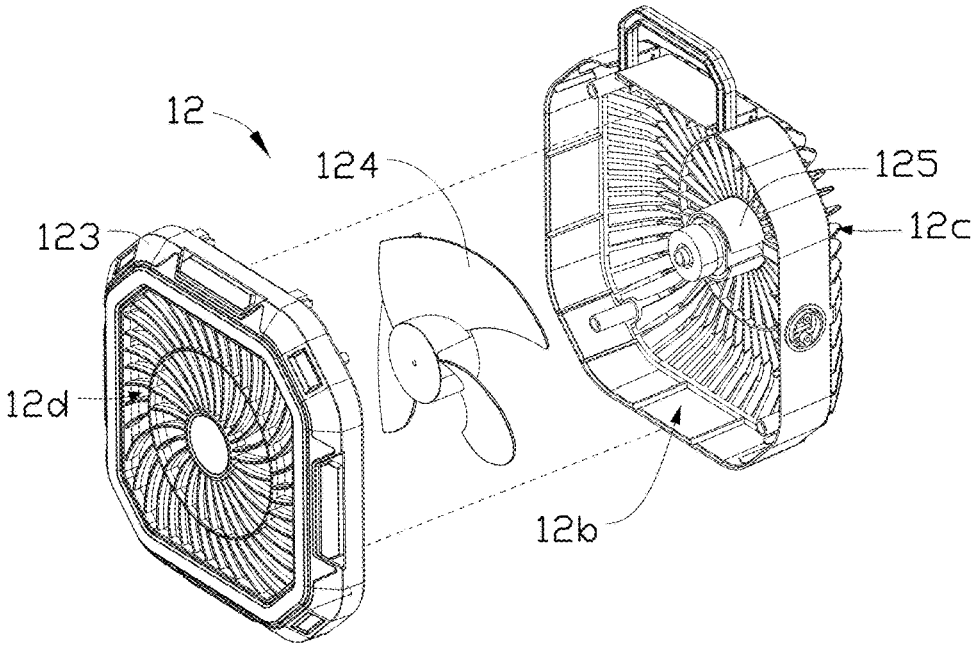
FIG. 5 is an exploded view of a fan head of the fan shown in FIG. 3.

Refer to FIG. 5, the fan body 12 includes a fan housing 123, a plurality of blades 124, and a motor 125. The fan body 12 is provided with an internal chamber 12*b*, an air inlet surface 12*c*, and an air outlet surface 12*d*. The internal chamber 12*b*, the air inlet surface 12*c*, and the air outlet surface 12*d* are in air communication with each other. The fan blades 124 are received in the internal chamber 12*b*, and the air inlet surface 12*c* is disposed opposite to the air outlet 12*d*. Two ends of the motor 125 are electrically and mechanically connected to the fan blades 124 and the power supply assembly 20, respectively.

The fan blades 124 is driven to rotate relative to the fan housing 123 under the drive of the motor 125, facilitating air exchange between the internal chamber 12*b* and an external environment.

Refer to FIG. 3 and FIG. 4, two opposite sides of the fan body 12 are provided with two engagement holes 12*a* respectively. A first end of a first rotating shaft 121 is inserted into each engagement holes 12*a*, and a second end of the first rotating shaft 121 opposite to the first end is rotatably connected to the frame 11. When the fan body 12 is driven to rotate, the first rotating shaft 121 is driven to rotate simultaneously with respect to the frame 11.

The frame 11 includes two half-shells (not labeled) that engaged together with each other. Each half-shell includes a hollowed-out area at a position corresponding to the engagement hole 12*a* of the fan body 12. When assembling the two half-shells, the hollowed-out areas jointly form a first receiving cavity 11*a*. The first receiving cavity 11*a* is configured to receive the second end of the first rotating shaft 121, and a first gap is defined between the first rotating shaft 121 and the first receiving cavity 11*a*, so that the first rotating shaft 121 is capable of rotating relative to the frame 11. In this embodiment, the first end of the first rotating shaft 121 is fixed to the fan body 12 via the engagement hole 12*a*, so that the first rotating shaft 121 is capable of rotating with the fan body 12 along the second direction R2 relative to the frame 11 under external driving force provided by users.

The frame 11 further includes a limiting structure 13. The limiting structure 13 is also received in the first receiving cavity 11*a* and is configured for adjust and define a rotation angle of the air outlet surface 12*d* relative to the horizontal plane. The limiting structure 13 includes a gear 131 and an elastic member 132. The gear 131 is mounted on the first receiving cavity 11*a* and rotatably connected to the second end of the first rotating shaft 121, so that the first rotating shaft 121 is capable of rotating with respect to the gear 131. The elastic member 132 includes a first end and a second end opposite to the first end, the first end of the elastic member 132 is fixedly coupled to the second end of the first rotating shaft 121, so that the elastic member 132 is capable of rotating with the first rotate shaft 121, and the second end of the elastic member 132 is abutted against the gear 131. When the fan body 12 and the first rotating shaft 121 rotate, the elastic member 132 elastically deforms and rotates with respect to the gear 131 and the frame 11, and when the fan body 12 stops rotating, the elastic member 132 elastically rebounds and abuts against the gear 131, and a gravity force of the fan head 12 is less than a abutting force of the elastic member 132 on the gear 131, so that the fan head 12 cannot rotate under the gravity force of the fan head 12, and the air outlet surface 12*d* of the fan head 12 is limited to be kept at a preset angle relative to the ground.

The gear 131 includes a plurality of teeth 1311, the teeth 1311 are protruded on the periphery of the gear 131, and a gear groove is defined between adjacent teeth 1311. The second end of the elastic member 132 is capable of receiving in a gear groove to be fixed. When a force is provided to the fan body 12 along the second direction R2, the fan body 12 and the first rotating shaft 121 simultaneously rotate along the second direction R2, and the elastic member 132 is driven to rotate and elastically pass through the gear groove. When the external force is removed, the second end of the elastic member 132 is fixedly received in the gear groove, and the fan body 12 stops rotating, so that the air outlet 12*d* is fixed at a preset angle.

In some other embodiments, two opposite sides of the frame 11 are provided with a first driving mechanism (not shown) respectively. The first driving mechanism may be a motor, a shaft of the motor fixedly connects to the fan body 12, and the shaft is capable of rotating with the fan body 12 relative to the frame 11. When the first drive mechanism starts to rotate, the fan body 12 is driven to rotate with respect to the frame 11, thereby replacing manual application of driving force.

The fan head 10 further includes an adjustment component 21*a* (as shown in FIG. 3), which is configured to adjust the electric power by the power supply assembly 20 to the motor 125. The adjustment component 21*a* may be a button, for example, when the button is pressed for the first time, the fan body 12 outputs a very small wind force. As the number of button presses increases, the wind force output by the fan body 12 gradually increases. When the fan body 12 reaches a pre-set maximum power value, the last button press disconnects the electrical connection between the power supply assembly 20 and the motor 125. Alternatively, the adjustment component 21*a* may be a rotary knob, for instance, when the rotary knob is turned clockwise, the wind force output by the fan body 12 gradually decreases. Conversely, when the rotary knob is turned counterclockwise, the wind force output by the fan body 12 gradually increases.

Figure 2:
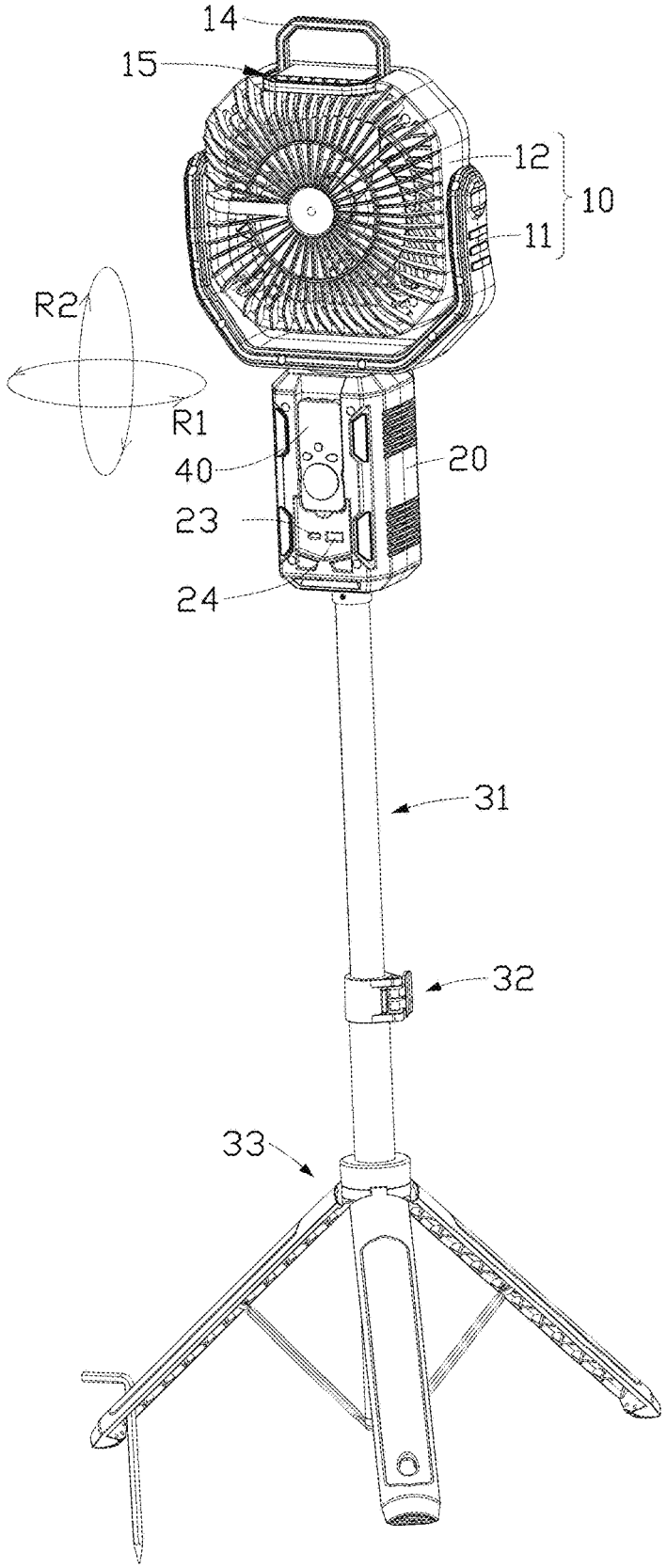
FIG. 2 is a perspective view of the fan shown in FIG. 1 shown from another view direction.

Refer to FIG. 2, a top surface of the fan 100 is provided with a handle 14, the handle 14 connects to the fan body 12, thereby allowing users to carry the fan conveniently.

The fan body 12 also includes an installation groove 15 configured for receiving the handle 14, the installation groove 15 is positioned corresponding to the handle 14. When the fan needs to be hung or carried, the handle 14 is capable of being rotated outward for convenience, and when the handle 14 is not needed, the handle 14 can be received in the installation groove.

In some embodiments, the handle 14 is made of a flexible material (e.g., leather or a strap) to prevent breakage from impact.

As shown in FIG. 3, a light 122 is arranged to surround an outer circumference of the fan body 12. The light 122 has two lighting modes, include a constant-on mode and a flashing mode.

The fan 100 also includes an adjustment structure configured to adjust the brightness of the light. In this embodiment, the adjustment structure is electrically connected to the light and the power supply assembly, and the adjustment structure may be a button. For example, when the button is pressed for the first time, the light 122 outputs a very low brightness. As the number of button presses increases, the brightness output by the light 122 gradually increases. When the light 122 reaches the set maximum power value, the last button press disconnects the electrical connection between the power supply assembly 20 and the light 122. Alternatively, the adjustment structure may be a knob. For example, when the knob is turned clockwise, the brightness output by the light 122 gradually decreases. Conversely, when the knob is turned counterclockwise, the brightness output by the light 122 gradually increases.

Refer to FIG. 3, the power supply assembly 20 has a cubic structure and is disposed at an end of the frame 11. The power supply assembly 20 includes a first engagement element 201 electrically and rotatably connected to the frame 11 and a second engagement element 210 detachably connected to the supporting bracket 30. The first and second engagement elements are arranged opposite to each other.

The power supply assembly 20 includes a housing 21, the interior of which defines an accommodating space. A power bank 20*a* is received in the accommodating space and configured to supply power to the fan head 10.

A bottom surface of the housing 21 may be a flat contact surface that stably adheres to tables or the ground, ensuring the power supply assembly 20 remains upright and does not tip over when placed independently. The power supply assembly 20 integrates the power bank 20*a* and a control panel. When the power supply assembly 20 combines with the fan head 10, the power bank 20*a* supplies electricity to operate the fan head 10. An outer surface of the housing 21 is equipped with multiple control buttons, which are electrically connected to battery 20*a* and the control panel to independently control the activation and deactivation of fan head 10.

A weight of the fan head 10 is comparable to that of the power supply assembly 20, and the geometric centers of the fan head 10 and the power supply assembly 20 are aligned along an imaginary line, ensuring the combined center of gravity of the two components lies on the imaginary line. This design guarantees the stable equilibrium of the fan 100 when placed on tables or the ground, eliminating the risk of tipping.

When a height difference exists between an air outlet of the fan head 10 and the users, the overall height of the fan 100 can be adjusted by installing or removing the supporting bracket 30, allowing the air outlet of the fan head 10 to precisely align with the users. When the users are standing, one end of the supporting bracket 30 is fixed to the ground, and another end of the supporting bracket 30 is connected to the power supply assembly 20 to elevate the height of the fan 100. When the users are seated, the supporting bracket 30 is capable of being detached, and the combined fan head 10 and the power supply assembly 20 can be placed directly on a table to direct airflow toward the users.

In alternative embodiments, the bottom surface of the housing may be designed as a contact surface with a specific shape (e.g., curved, inclined, or with specialized mounting interfaces) to adapt to various application scenarios.

The housing 21 is rotatably connected to the frame 11 through the first engagement element 201. In this embodiment, the first engagement element 201 may be motor, the motor is received in the accommodating space, a second rotating shaft 211 of the motor protrudes and extends from the accommodating space, and connected to the frame 11.

The frame 11 has a corresponding second rotating hole 11*b*. The accommodating space is in air communication with the second rotating hole 11*b*. The second rotating shaft 211 is inserted into the second rotating hole 11*b* and fixedly connected to the frame 11, allowing the frame 11 to rotate with the second rotating shaft 211 relative to the power supply assembly 20 under the drive of the motor.

Figure 6:
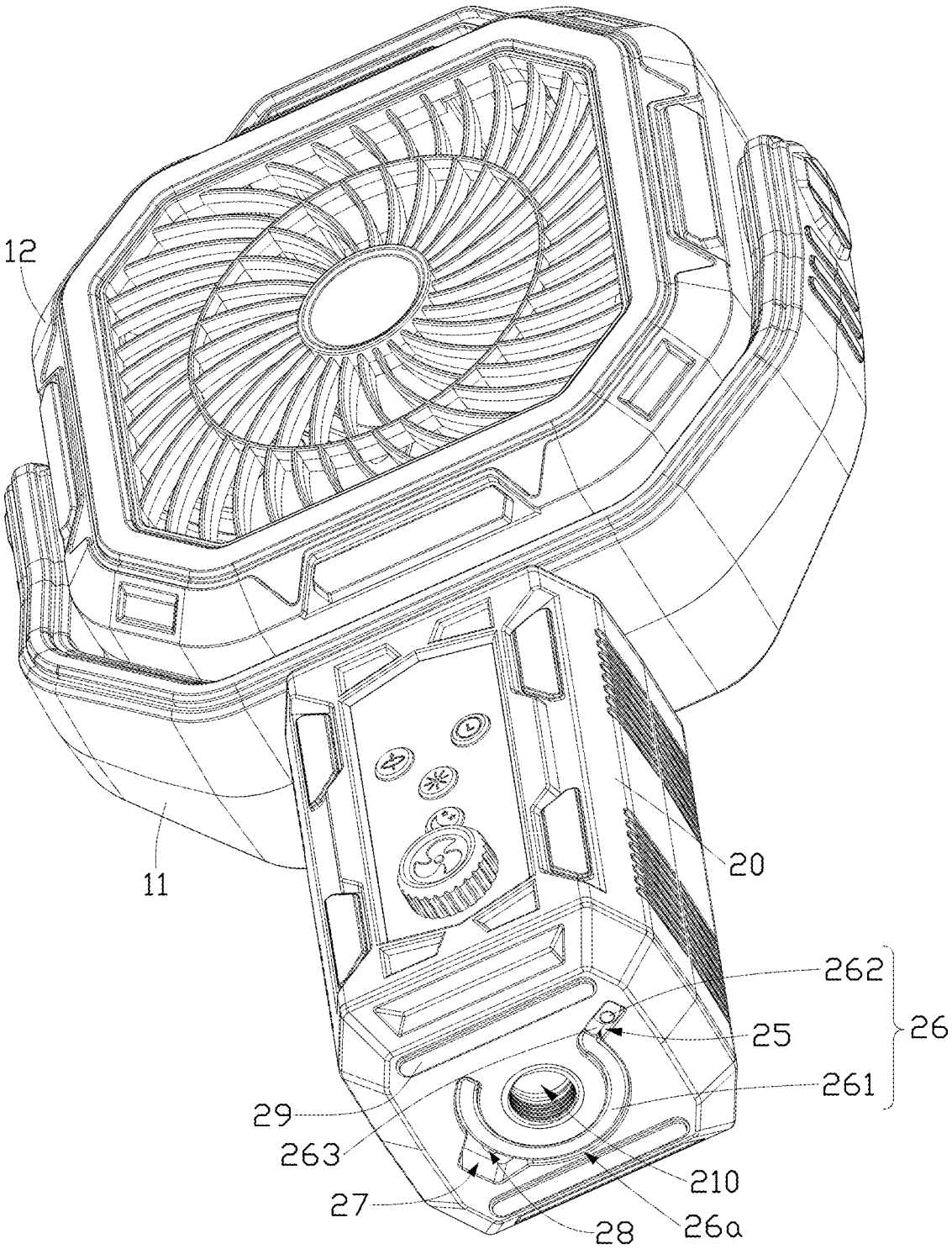
FIG. 6 presents a perspective view of the top part of the fan as shown in FIG. 1, with the supporting bracket omitted.
Figure 7:
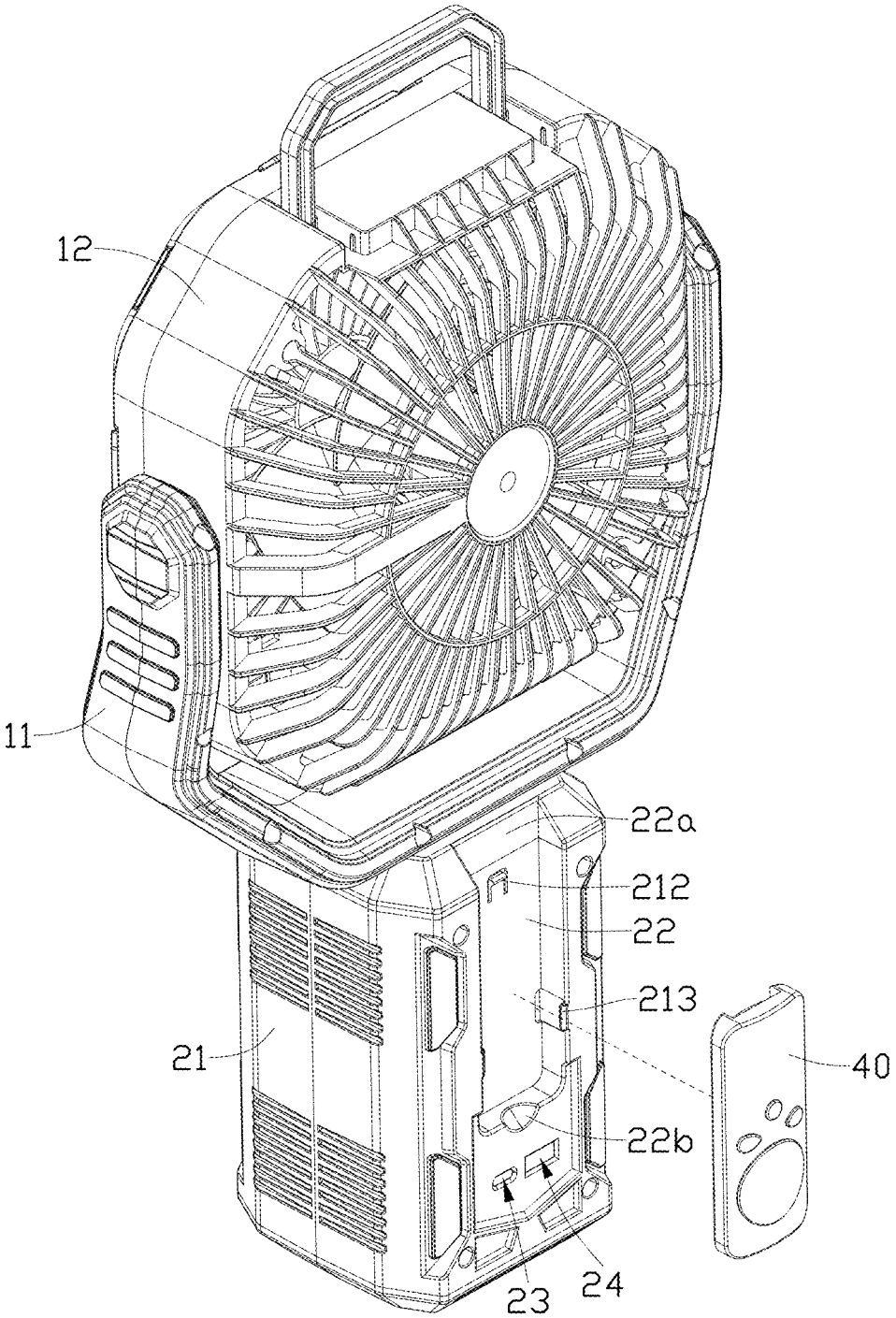
FIG. 7 is an exploded view showing a fan controller and a power supply assembly of the fan shown in FIG. 6.
Figure 8:
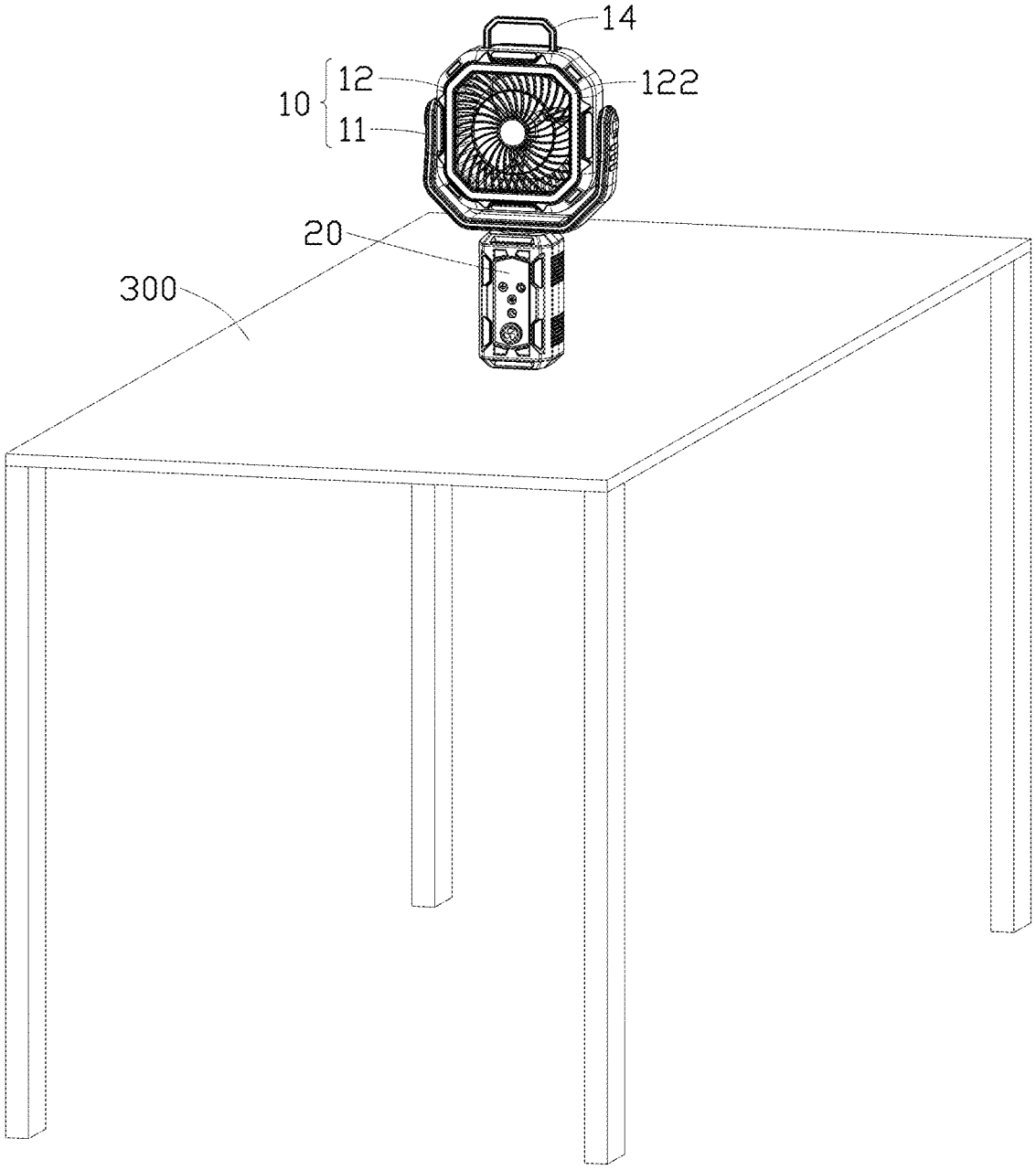
FIG. 8 is a view showing a first usage state that the fan is on a support surface.

Refer to FIGS. 6 to 8, the housing 21 is detachably connected to the supporting bracket 30 (as shown in FIG. 1). The connection method includes threaded connection, snap-fit connection, magnetic connection, or plug-in connection. In this embodiment, the housing 21 and the supporting bracket 30 are connected via a threaded interface. An end of the power supply assembly 20 away from the fan head 10 is a flat surface, allowing the power supply assembly 20 to be stably placed on the ground or the desktop.

The outer circumference of an end of the supporting bracket 30 near the housing 21 is wound with threads, and a bottom of the housing 21 defines a threaded hole corresponding to the threads, that is, the second engagement element 210 is a threaded hole. When the supporting bracket 30 attaches to the housing 21, an end of the supporting bracket 30 is inserted into the threaded hole and fixedly received in the threaded hole through the threads. When need to detach the supporting bracket 30 from the housing 21, the supporting bracket 30 rotates relative to the power supply assembly 20 and gradually detaches from the threaded hole.

An anti-slip pad 29 is disposed at a bottom of the housing 21. The anti-slip pad 29 is configured for preventing the power supply assembly 20 from sliding relative to the desktop or the ground. When the power supply assembly 20 serves as a first base and is placed on the desktop 300, the anti-slip pad 29 increases friction between the power supply assembly 20 and the desktop 300, reducing the likelihood of the power supply assembly 20 tipping over due to external forces.

As shown in FIG. 6, a bottom of the power supply assembly 20 recesses with a receiving space 25, and a mounting accessory 26 engages with the housing 21. In this embodiment, the mounting accessory 26 may be a hook. The hook 26 has a shape, for example, has an arcs shape, which matches a shape of the receiving space 25. The hook 26 includes a free end 261 and a mounted end 262 fixedly connected to the housing 21, a pivot shaft 263 is located between the free end 261 and the mount end 262, enabling the free end 261 to rotate relative to the mounted end 262.

The mounted end 262 is fixed in the receiving space 25, and the free end 261 is capable of rotating relative to the mounted end 262 via the pivot shaft 263 and leaving from the receiving space 25.

Figure 9:
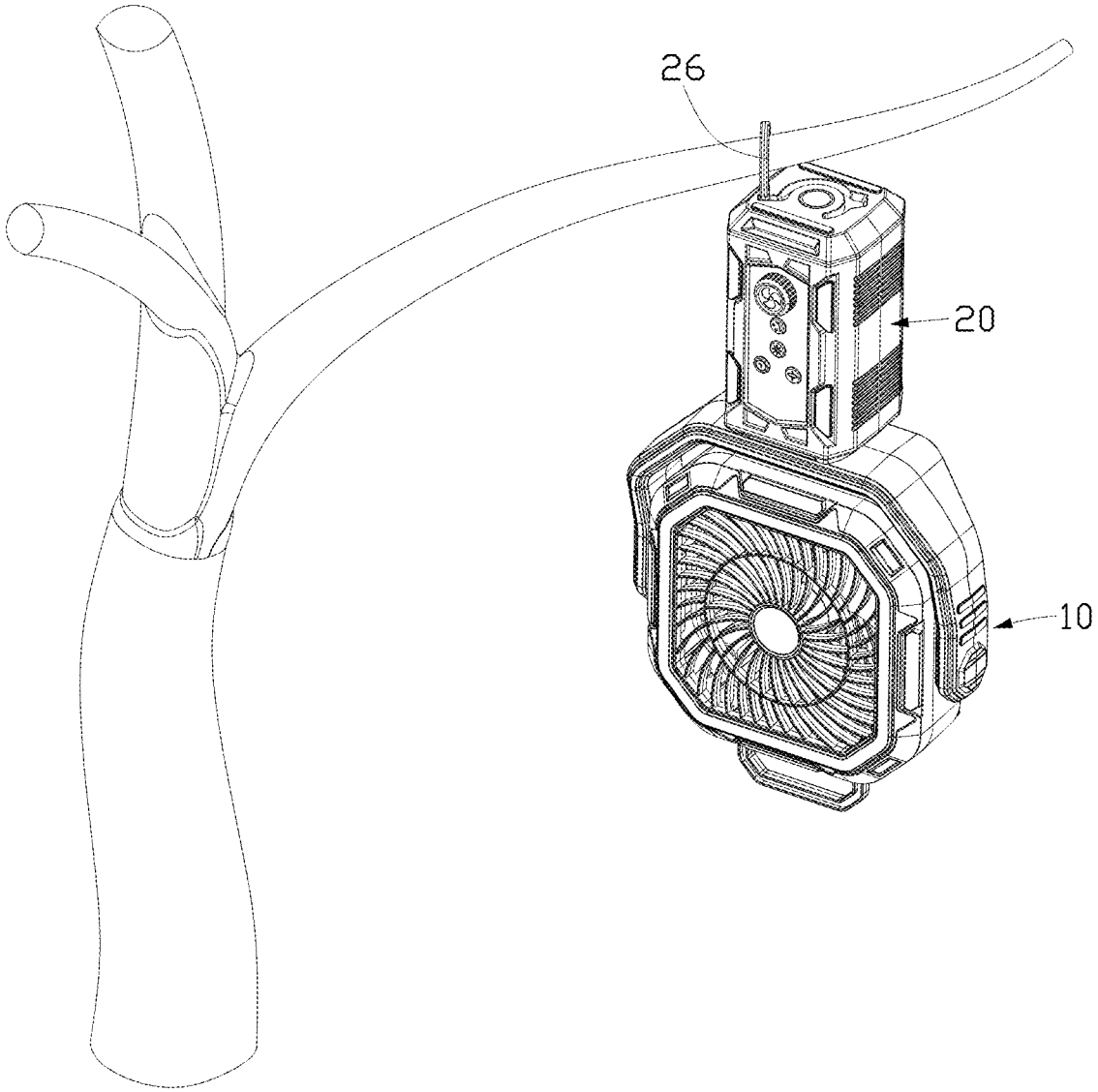
FIG. 9 shows a diagram of a second usage state in which the fan is suspended.

The hook 26 has a stowed state and an extended state. When the hook 26 in the stowed state, the hook 26 is received in the receiving space 25, and the bottom the housing 21 is a flat surface which is capable of acting as a first base to place on the desktop or the ground. When the hook 26 in the extended state, the free end 261 of the hook 26 leaves from the receiving space 25, a combination of the fan head 10 and the power bank 20*a* is suspended on an object by the hook 26. In this embodiment, the object may be a tree branch of a tree (as shown in FIG. 9).

A retaining structure 26*a* is protruded from a top inner side wall of the receiving space 25, the retaining structure 26*a* is configured for fixing the hook 26 to receive in the receiving space 25 and preventing the hook 26 from accidentally disengaging with the receiving space 25 without an external force. The retaining structure 26*a* has elasticity, allowing the hook 26 to be pressed inward to engage from the receiving space 25.

A first recess 27 is formed on a side of the receiving space 25 and is in air communication with the receiving space 25, the hook 26 is completely received in the receiving space 25 in the stowed state, and the second end of the hook 26 is capable of being pulled out of the receiving space 25 through the first recess 27 by users.

A concave groove 28 is configured to separate the hook 26 from the receiving space 25. The concave groove 28 is defined on a bottom surface of the first recess 27, which is close to the receiving space 25, and the concave groove 28, is in air communication with the receiving space 25 and the first recess 27.

It can be understood that the mounting accessory may be a rope with one end fixed to an outer side wall of the housing 21 and the other end used for hanging objects, allowing the power assembly 20 and the fan head assembly 10 can be suspended and the fan head 10 is located below the power supply assembly 20.

A back surface of the power supply assembly 20 includes a mounting space 22, a charging port 23, and a discharge port 24. The mounting space 22 is used to mount a fan controller 40 which controls a circuit to be switched on and off and rotate direction of the fan 100. The charging port 23 and discharge port 24 are electrically connected to the power supply assembly 20 and allow connection with external connectors for charging or discharging the power bank 20*a*.

The charging port 23 and discharge port 24 are both engaged with sealing components, respectively, the sealing components cover the exits of the charging port 23 and discharge port 24 to reduce the risk of rainwater ingress. The sealing components are made of waterproof materials such as silicone or rubber.

The mounting space 22 is in air communication with the accommodating space. A plate 212 has elasticity and attaches to the housing 21, a side of the plate 212 is protruded from a bottom surface of the mounting space 22. The plate 212 is configured for abutting against the fan controller 40. When the fan controller 40 is received in the mounting space 22, one side of the plate 212 is pressed by the gravity of the fan controller 40 and is accommodated in the accommodating space. When the fan controller 40 is taken out from the mounting space 22, the plate 212 is spring up towards the direction of the mounting space 22 under an action of elasticity, so that the fan controller 40 can be quickly separated from the mounting space 22.

Two retaining edges 213 protrude inward from both sides of the mounting space 22 so as to prevent the fan controller 40 separate from the mounting space 22 under an absence of external forces. When the fan controller 40 is placed in the mounting space 22, the two retaining edges 213 are cooperatively to clamp the fan controller 40 in place.

An end of the mounting space 22 near the fan body 12 defines an open slot 22*a*, allowing the fan controller 40 to be extracted. The housing 21 further includes a second recess 22*b* opposite the open slot 22*a*, the second recess 22*b* is in air communication with the mounting space 22 and the open slot 22*a*, and the fan controller 40 is easy to push out from the mounting space 22 through the open slot 22*a* and the second recess 22*b*.

Figure 10:
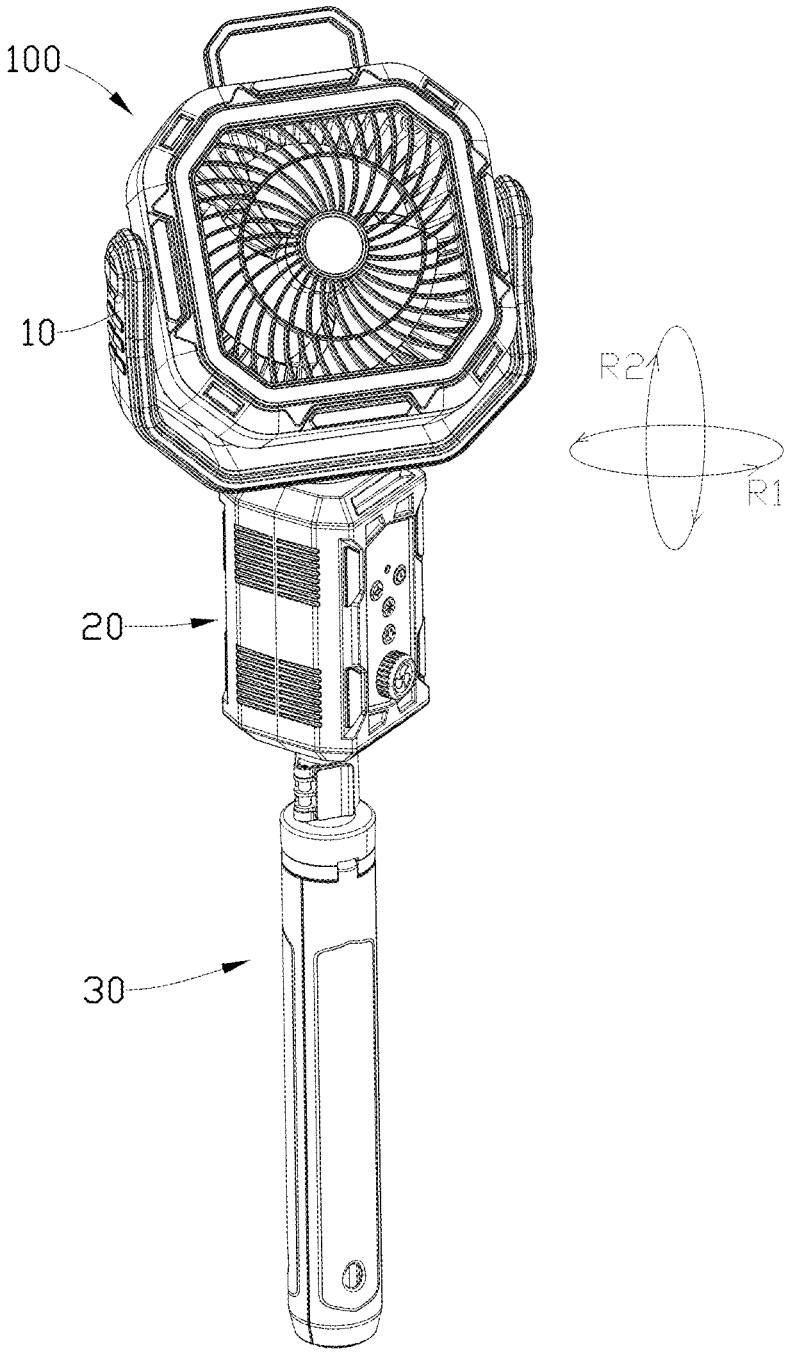
FIG. 10 is a perspective view showing a portion of a telescopic rod received in another portion of the telescopic rod of the fan shown in FIG. 2.
Figure 11:
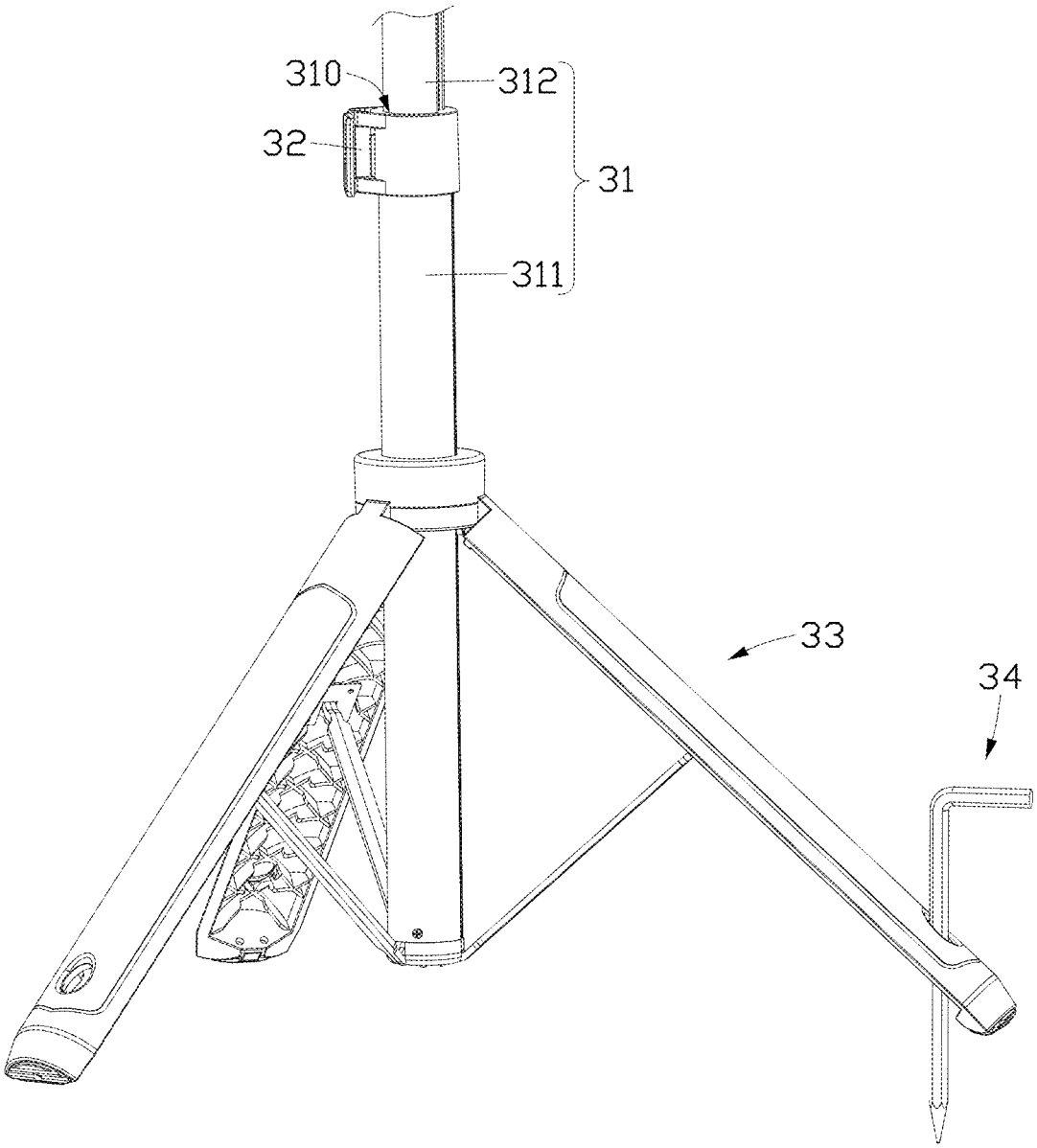
FIG. 11 is a perspective view of the supporting bracket which comprises a supporting assembly, the telescopic rod and a locking portion shown in FIG. 2.

Refer to FIG. 10 and FIG. 11, the supporting bracket 30 may be a floor-standing bracket, and configured to support a combination of the fan head 10 and the power supply assembly 20 on a ground. The supporting bracket 30 includes a telescopic rod 31, which is detachably connected to the power supply assembly 20. The telescopic rod 31 is used to adjust the height of the fan head 10 relative to the ground, thereby meeting the users' different requirements for airflow height and facilitating portability. When the distance between the fan head 10 and the ground or the desktop is smaller, the stability of the fan 100 increases.

One end of the telescopic rod 31 is threadedly connected to the housing 21. In some embodiments, the telescopic rod 31 extends along a length direction along its length. In this embodiment, the telescopic rod 31 includes at least two rods. One end of the at least two rods is detachably connected to the power supply assembly 20, and the other end of the at least two rods is connected to a supporting base 33.

The telescopic rod 31 is switchable between an extended state and a stowed state. The telescopic rod 31 includes a first rod 311 and a second rod 312 which has a slightly smaller diameter than the first rod 311, and a gap 310 is defined between the first rod 311 and the second rod 312. When the telescopic rod 31 is in the extended state, the first rod 311 extends relative to the second rod 312, and when the telescopic rod 31 is in the stowed state, the second rod 312 is partially or fully received in the first rod 311.

Refer to FIG. 11, the supporting bracket 30 further includes a locking assembly 32, which has an unlocked state and a locked state. When the locking assembly 32 is in the unlocked state, adjacent rods are capable of moving relative to or away from each other. When the locking assembly 32 is in the locked state, the adjacent rods are restricted to move.

Figure 12:
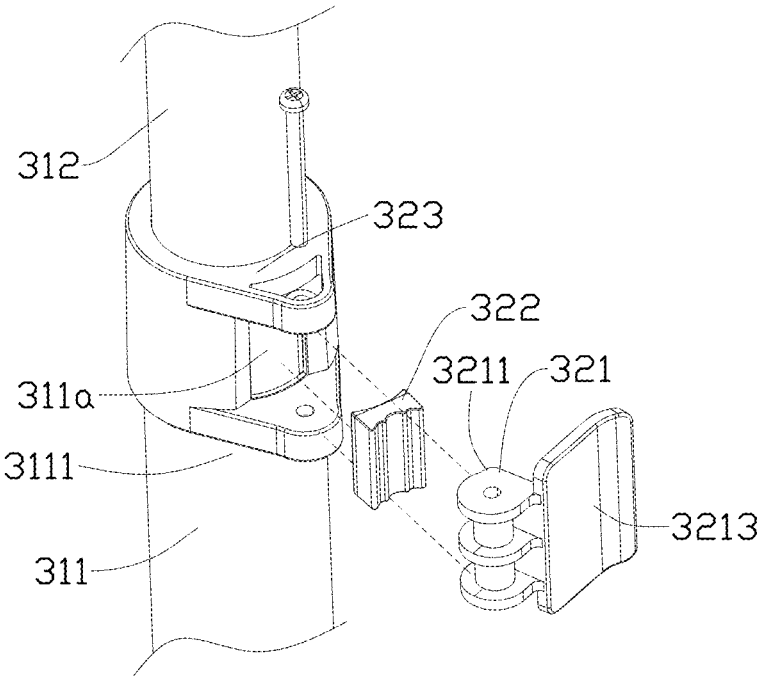
FIG. 12 is an exploded view of the locking portion according to another embodiment of the fan.

Refer to FIG. 12, in some embodiments, the locking assembly 32 includes a first pole 321, an elastic pad 322 and a clamping cover 323. The clamping cover 323 covers a periphery of the first rod 311, the first pole 321 rotatably attaches to a side of the clamping cover 323, and the elastic pad 322 is sandwiched between the first pole 321 and the clamping cover 323. The clamping cover 323 defines a hole through which the elastic pad 322 passes. An extension portion 3111 extends from an end of the first rod 311 along the length direction, and a portion of the second rod 312 is received in the extension portion 3111. The extension portion 3111 defines a first through-hole 311*a* corresponding to the hole, the first through-hole 311*a* is in air communication with the hole and cooperatively to be inserted by the elastic pad 322, so that the extension portion 3111 is contactable with the second rod 312. When the first pole 321 is rotated relative to the extension portion 3111, and a protrusion 3211 of the first pole 321 compresses the elastic pad 322, the gap 310 is squeezed by the elastic pad 322, so that the elastic pad 322 presses against the second rod 312, thereby preventing the second rod 312 from moving relative to the first rod 311. When a protrusion 3211 of the first pole 321 does not compress the elastic pad 322, the gap 310 remains exit, allowing the second rod 312 to move relative to the first rod 311. A handle portion 3213 extends from a side of the first pole 321 away from the elastic pad 322, and the handle portion 3213 is configured for holding by the users.

Figure 13:
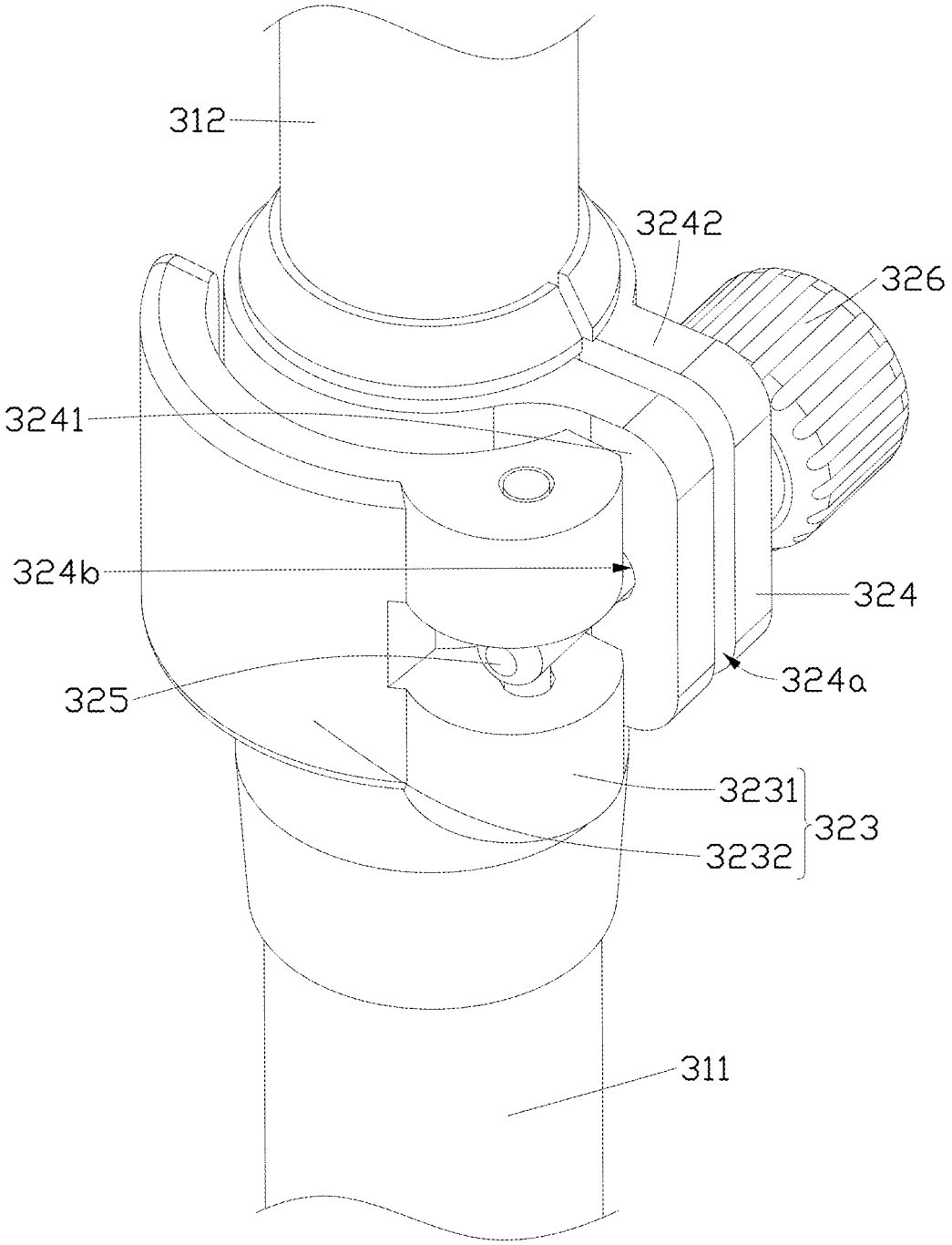
FIG. 13 is a view of the locking portion according to an alternative embodiment of the fan.

Please refer to FIG. 13, in some embodiments, the locking assembly 32 includes a pressing plate 323, a clamping sleeve 324, a screw 325, and a nut 326. The clamping sleeve 324 covers the outer circumference of the extension portion 3111, and two ends of the clamping sleeve 324 are opposite to each other and cooperatively to form an opening 324*a*.

The two ends of the clamping sleeve 324 are defined as a first side wall 3241 and a second side wall 3242, respectively. The clamping sleeve 324 is provided with a second through-hole 324*b*, which extends from the first side wall 3241 to the second side wall 3242. The pressing plate 323 is located on a side of the first side wall 3241 opposite the second side wall 3242, and the nut 326 is located on a side of the second side wall 3242 opposite the first side wall 3241. One end of the screw 325 is rotatably connected to the pressing plate 323, and the other end of the screw 325 is inserted into the second through-hole 324*b* and threaded into the nut 326. The pressing plate 323 is capable of moving reciprocally between a first preset position and a second preset position. In the first preset position, a protrude portion 3231 of the pressing plate 323 and the nut 326 cooperatively to clamp the first side wall 3241 and the second side wall 3242, so that the clamping sleeve 324 grips the second rod 312, thereby locking the first rod 311 relative to the second rod 312. In the second preset position, at least one gap exists between a recess part 3232 of the pressing plate 323 and the first side wall 3241, or the at least one gap exists between the nut 326 and the second side wall 3242, so that the first rod 311 is unlocked relative to the second rod 312, and the second rod 312 is capable of moving to stow in the first rod 311 or away from the first rod 311. That is to say, the whole length of the rod can be adjusted through adjusting the relative position of the first rod 311 and the second rod 312.

When adjusting the length of the telescopic rod 31, the pressing plate 323 moves from the first preset position to the second preset position, the clamping sleeve 324 grips the second rod 312, so that the second rod 311 is fixed relative to the first rod 311. By rotating the nut 326 to adjust its position relative to the screw 325, the distance between the pressing plate 323 and the nut 326 can be adjusted, further fine-tuning the clamping force of the clamping sleeve 324 on the second rod 312.

Figure 14:
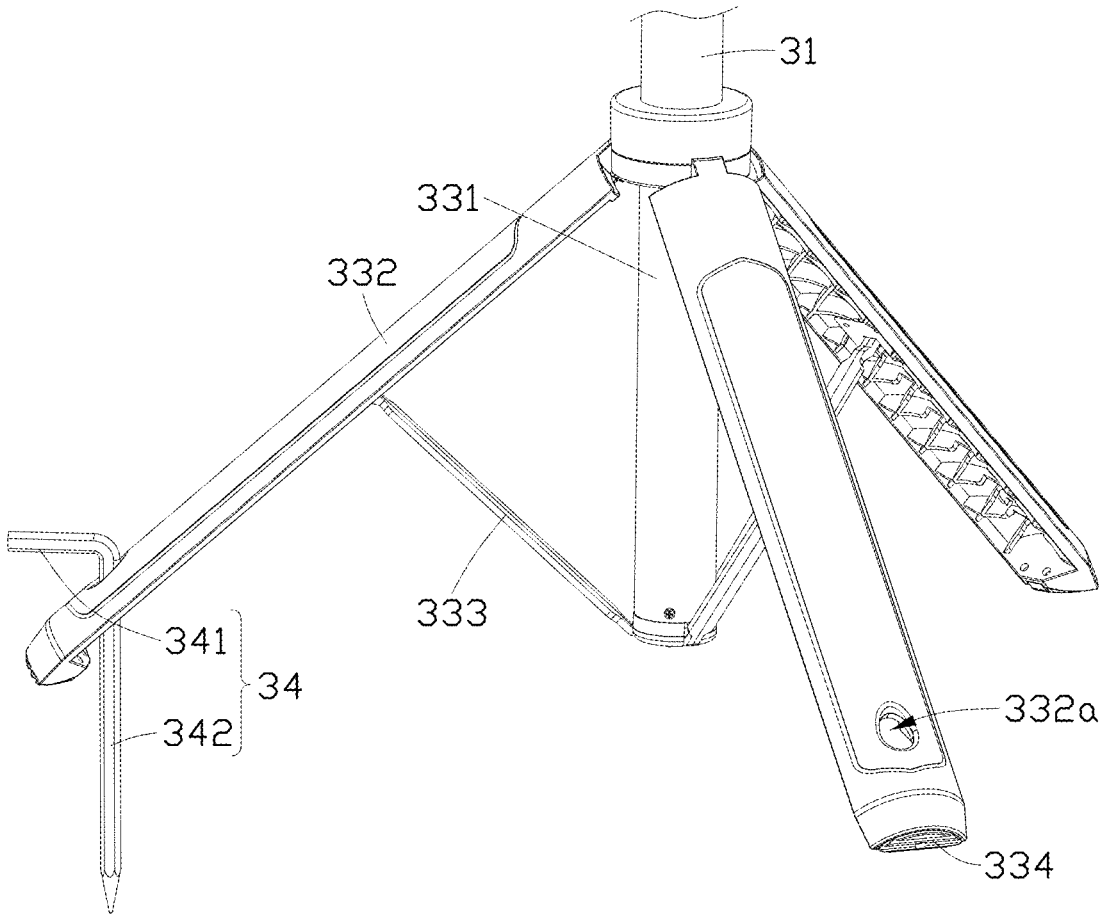
FIG. 14 is a view showing the supporting assembly engages with the telescopic rod of the fan shown in FIG. 11.

Refer to FIG. 14, the supporting bracket 30 further includes a supporting base 33, in this embodiment, the supporting base 33 may be a tripod assembly which is capable of operating in a stowed configuration and an extended configuration.

The tripod assembly includes a rod 331, three feet 332 and three connecting portions 333, the rod 331 is connected to an end of the telescopic rod 31 away from the power supply assembly 20, the three feet 332 are arranged around an outer circumference of the rod 331, and a top end of each foot 332 mounts on the rod 331, while a bottom end of each foot 332 opposite to the top end is contactable with the first support surface, one end of each connecting portion 333 is fixed to the bottom end of the rod 331, while the other end of each connecting portion 333 is slidable connected to the each feet 332. In the stowed configuration, the connecting portions 333 slide to the top end of the three feet 332, the three feet 332 of the tripod assembly retract towards the rod 331 and attach to a side surface of the rod 331, and in the extended configuration, bottom ends of the three feet 332 adjacent to the first support surface extend outwardly and form a triangular structure, the fan 100 can be stably placed on the first support surface.

An anti-slip pad 334 attaches to a bottom of each foot 332 so as to prevent each foot 332 from sliding on a smooth support surface.

An inner side wall of each foot 332 is provided with a first groove at the position corresponding to each connecting portion 333, and each connecting portion 333 is capable of being received in the first groove after the three feet 332 are retracted toward the rod 31.

In some embodiments, the supporting bracket 30 further includes a fixing element 34. The fixing element 34 is configured to limit the bottom end of the three feet 332 to move relative to the ground when the supporting base 33 is in the extended configuration.

The fixing element 34 is rotatably connected to the bottom end of each foot 332, and the fixing element 34 is capable of receiving in the first groove when the fixing element 34 is not using.

A fixing hole 332*a* is defined at the bottom end of each foot, which allows the fixing element 34 to be inserted. The fixing element 34 includes a first end 341 and a second end 342 which perpendicularly connected to the first end 341. The second end 342 has a needle-like structure, and the second end 342 is capable of passing through the insertion hole 332*a* and inserting into the ground to limit the movement of the three feet 332 away from the ground.

In some embodiments, the supporting bracket 30 further includes a locking structure 35. The locking structure 35 is configured to lock the each adjacent foot 332 pair when the supporting base 33 is in the stowed state, reducing the risk of the supporting base 33 transitioning from the stowed state to the extended state during transportation.

Figure 15:
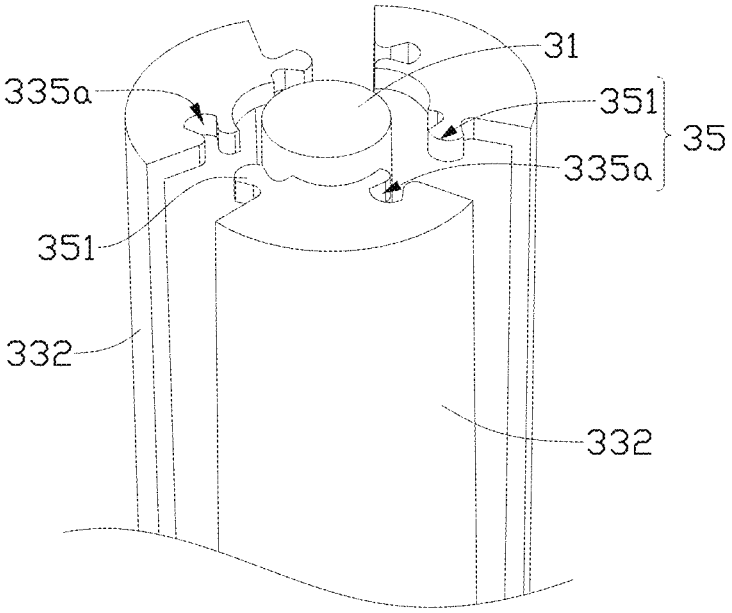
FIG. 15 is a view showing three feet of the supporting assembly engage with each other according to an alternative embodiment of the fan.

Refer to FIG. 15, the locking structure 35 is applied between the bottom ends of each adjacent foot 332 pair in the tripod assembly, the locking structure 35 comprises a female locking element 351 and a male locking element 335*a* engaged with the female locking element 351, the female locking element 351 extends from a lateral wall of the bottom end of one of the adjacent foot 332 pair, and the male locking element 335*a* is located at a mating surface of the lateral wall of another one of the adjacent foot 332 pair.

Figure 16:
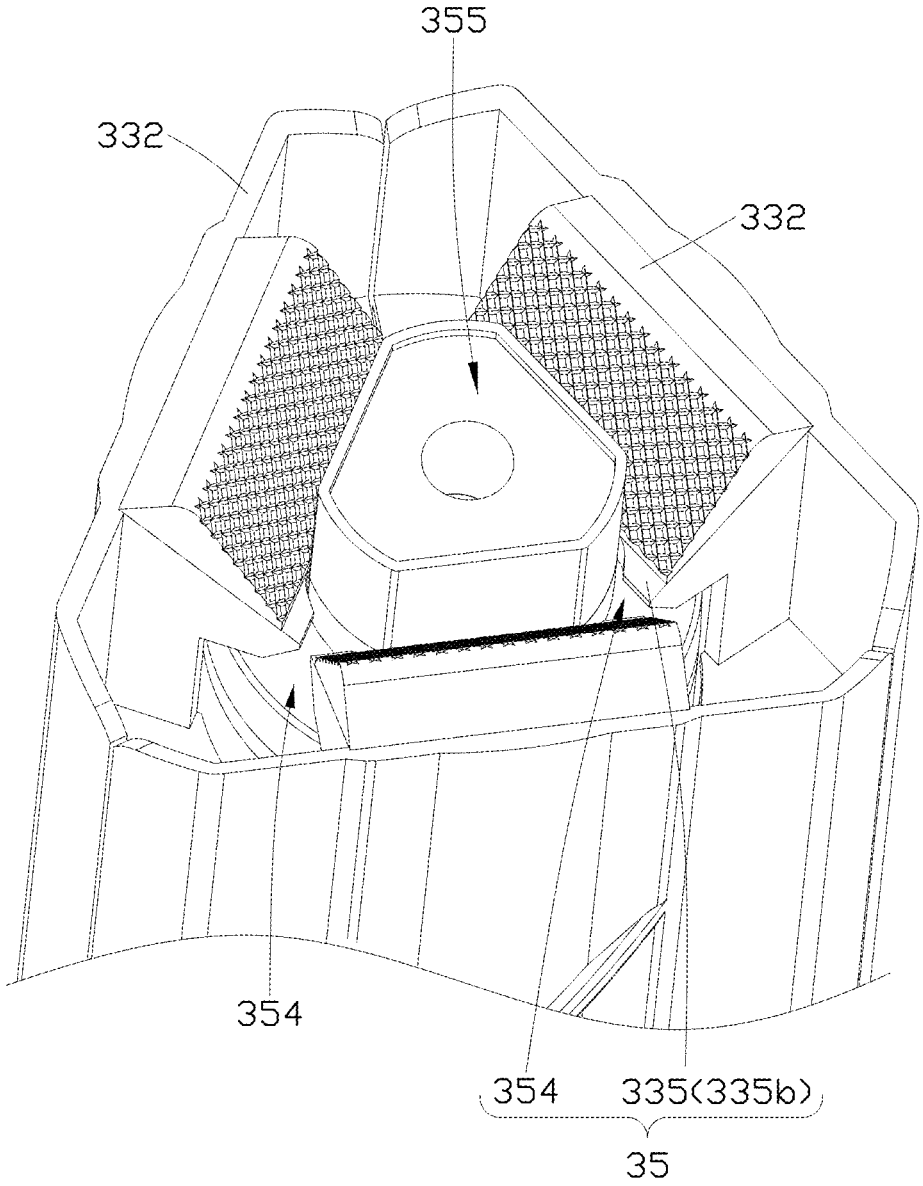
FIG. 16 is a perspective view showing the supporting assembly engages with the telescopic rod according to another alternative embodiment of the fan.
Figure 17:
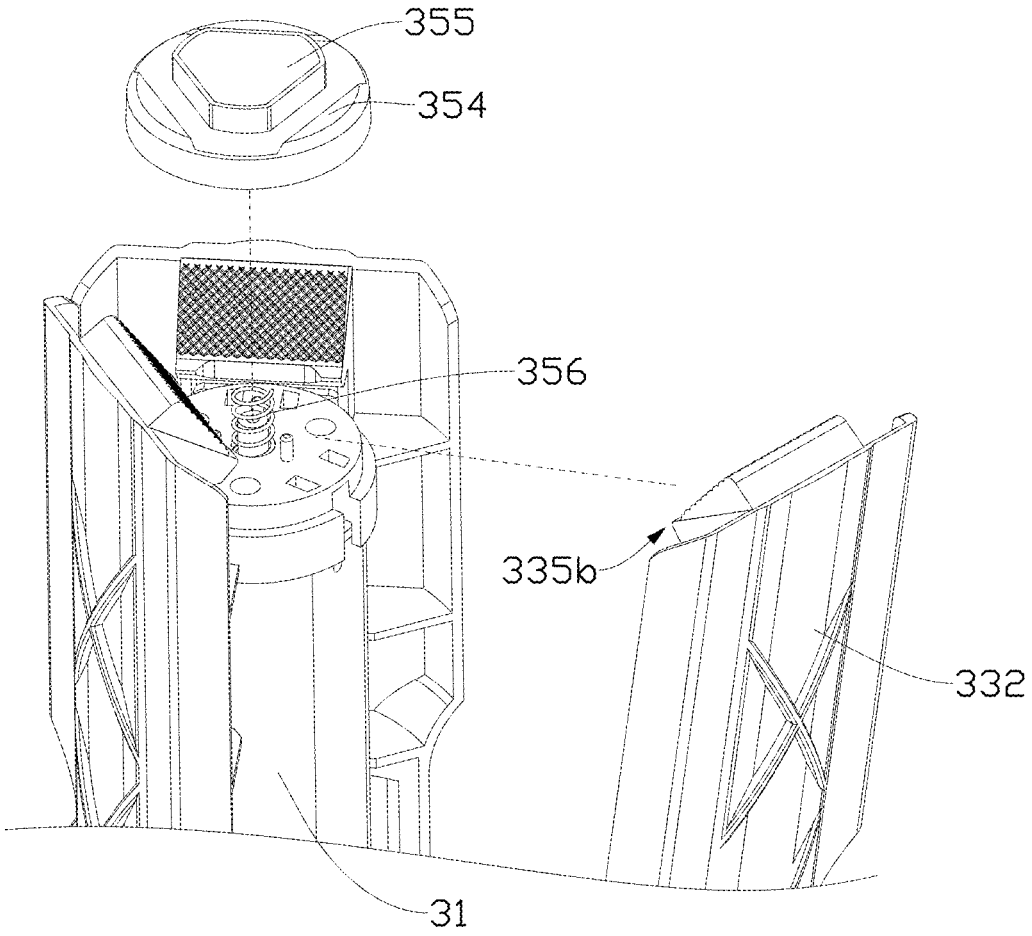
FIG. 17 is an exploded view showing the supporting assembly engages with the telescopic rod of the fan shown in FIG. 16.

Refer to FIG. 16 and FIG. 17, in some other embodiments, a release structure configured to make the three feet 332 to be switched from the stowed configuration to the extended configuration. The release structure comprises a pressing member 355 and an elastic member 356, the elastic member 356 is sandwiched between the pressing member 355 and a bottom surface of the rod 331, the locking structure 35 comprises a female locking member 354 located at the pressing member 355 and a male locking member 335*b* located at a corresponding portion of the bottom end of each feet 332 and engaged with the female locking member 354, and when the pressing member 355 is pressed, the elastic member 356 is depressed so that the female locking member 354 is released from the male locking member 335*b*.

When using the fan 100, firstly, press the pressing member 355 to separate the three feet 332 from the female locking member 354, and then the three feet 332 extends relative to the rod 331 and form a stable triangular structure with the rod 331. Next, the second end 342 of the fixing element 34 is inserted into the ground. Then, the handle portion 3213 or nut 326 is rotated to tighten or loosen the elastic pad 322 or clamping sleeve 324 against the second rod 312, thereby adjusting the overall height of the telescopic rod 31. Next, adjust the airflow direction of the fan 100 in the first direction R1 or second direction R2 as needed. When the fan 100 needs to rotate in the first direction R1, press the corresponding button on the fan controller 40, causing the frame 11 to rotate relative to the power supply assembly 20 in the first direction R1. When the fan 100 needs to rotate in the second direction R2, press the corresponding button on the fan controller 40, causing the fan body 12 to rotate relative to the frame 11 in the second direction R2.

Alternatively, the telescopic rod 31 is detached from the power supply assembly 20. Then, place the power supply assembly 20 on the desktop 300 or use the hook 26 to hang the fan 100, making the fan head 10 is located below the power supply assembly 20, Next, press the buttons on the fan controller 40 as needed to adjust the fan's rotation angle in the first direction R1 and second direction R2.

Second Embodiment

The fan head 10 can be either separated from the power supply assembly 20 or electrically connected with the power supply assembly 20 through electrode pins.

Figure 18:
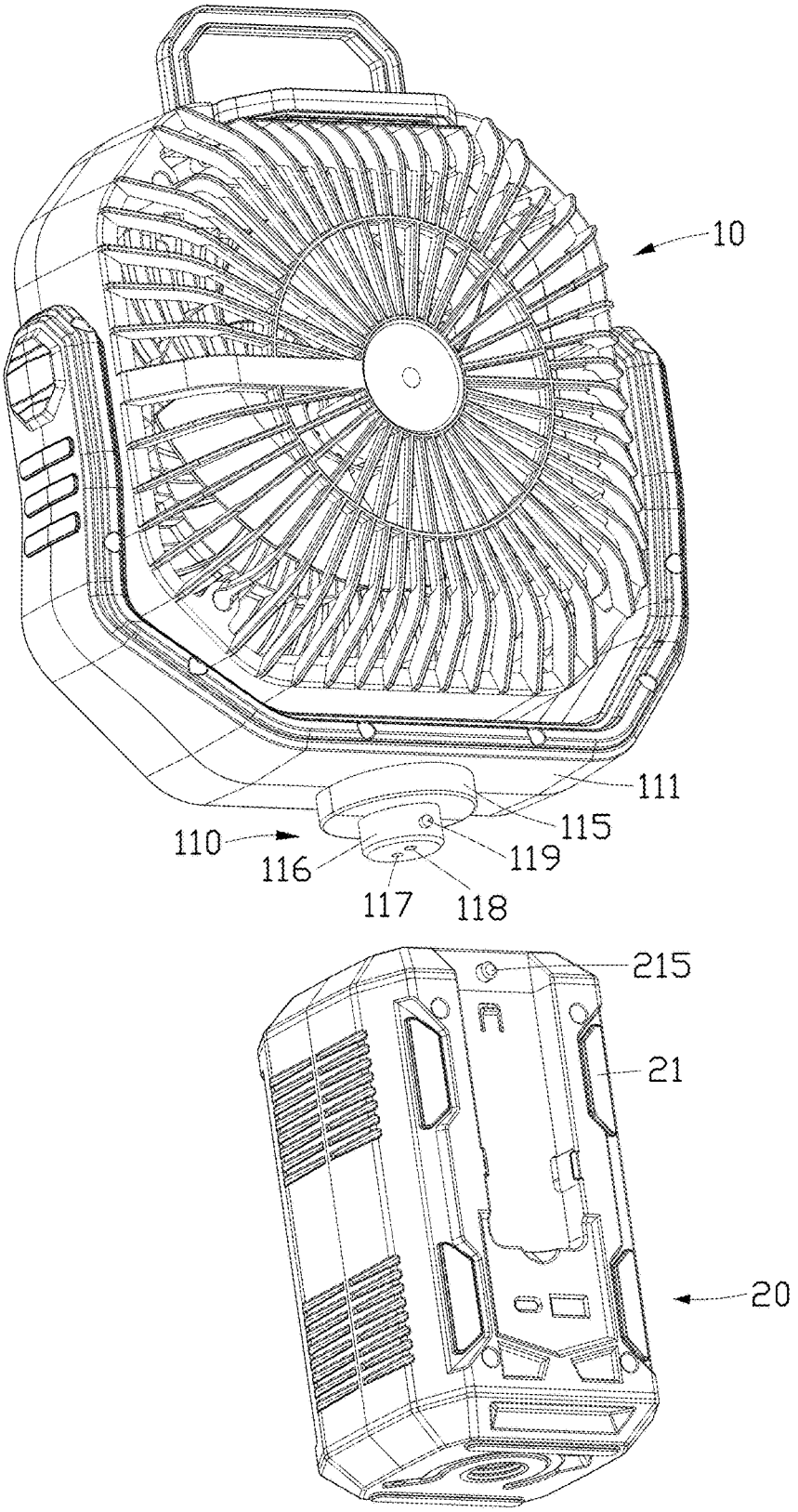
FIG. 18 is an exploded view showing a structure of the power supply assembly and the fan head of a fan according to a second embodiment of the present disclosure.
Figure 19:
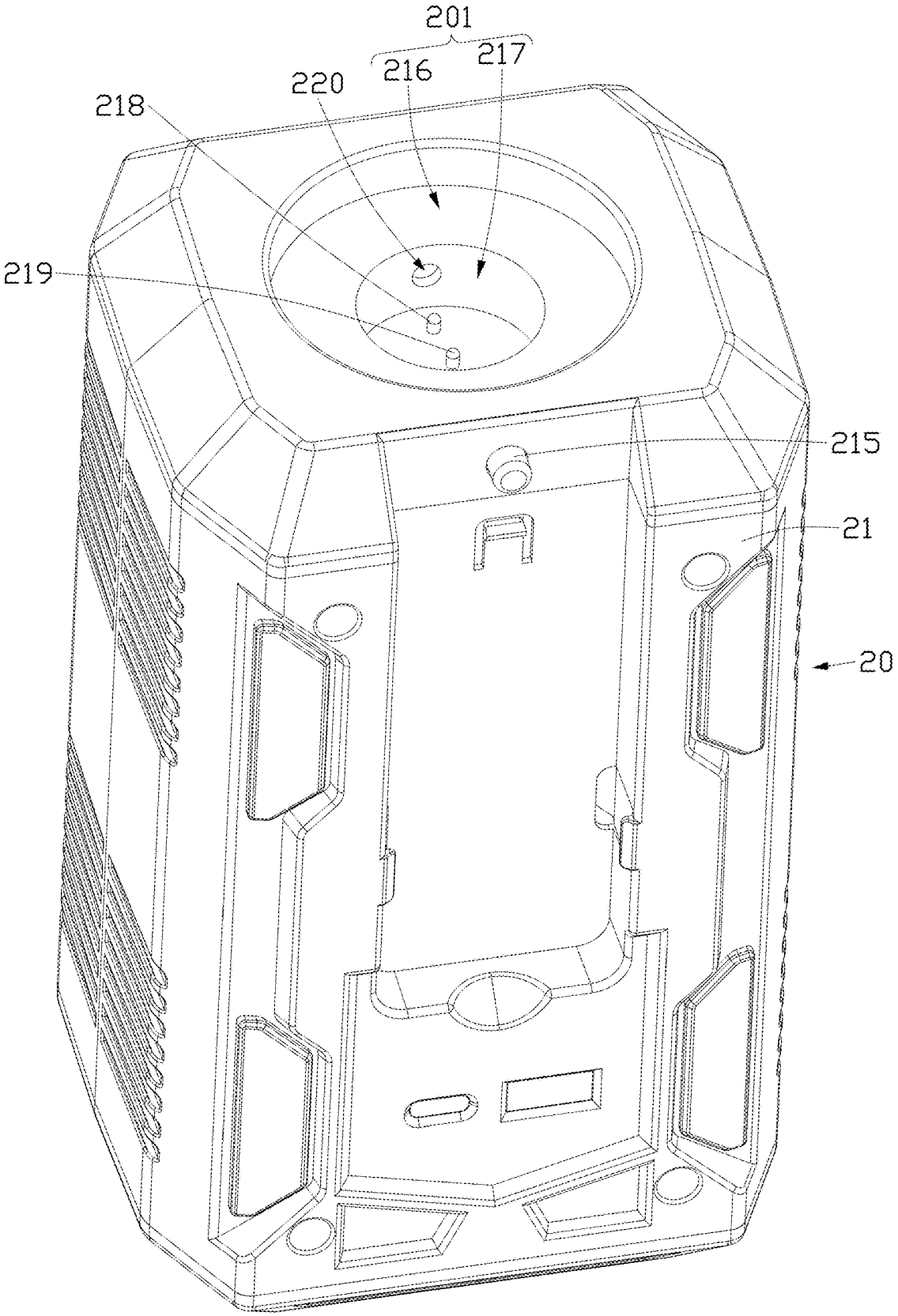
FIG. 19 is an exploded view of the structure of the power supply assembly and the fan head of the fan shown in FIG. 18 shown from another viewing direction.

Refer to FIG. 18 and FIG. 19, a connection structure 110 is protruded from the connection portion 111 toward the housing 21, and the connection structure 110 is electrically and mechanically engaged with the first engagement element 201, thereby connecting the fan head 10 and power supply assembly 20. In this embodiment, the first engagement element 201 includes a first hole 216 and a second slot 217 formed along the length direction, and the first hole 216 is in air communication with the second slot 217. A pair of electrode pins, including a first positive electrode pin 218 and a first negative electrode pin 219 are arranged on a bottom surface of the second slot 217, and an inner wall of the second slot 217 is provided with a locking hole 220.

The connection structure 110 includes a first connection component 115 and a second connection component 116 fixedly connected to the first connection component 115. A driving motor is received in the connection structure 110.

A bottom of the second connection component 116 is provided with a pair of electrode pins, including a second positive electrode pin 117 and a second negative electrode pin 118. The first positive electrode pin 218 and the second negative electrode pin 118 establish electrical connection upon contact, the second positive electrode pin 117 and the first negative electrode pin 219 establish electrical connection upon contact. When the first connection component 115 is inserted into the first hole 216 and the second connection component 116 is inserted into the bottom surface of the second slot 217, the driving motor receives power, and electrical connection between the fan head 10 and power supply assembly 20 is achieved.

A first locking assembly 119 is protruded from a side wall of the second connection component 116 toward the locking hole 220. When the second connection component 116 is inserted into the second slot 217, the first locking assembly 119 engages with the locking hole 220, ensuring stable connection between the fan head 10 and the power supply assembly 20. The first locking assembly 119 is elastic. When pressing a rotary knob 215, the first locking assembly 119 is disengaged from the locking hole 220, thereby separating the fan head 10 from the power supply assembly 20.

Figure 20:
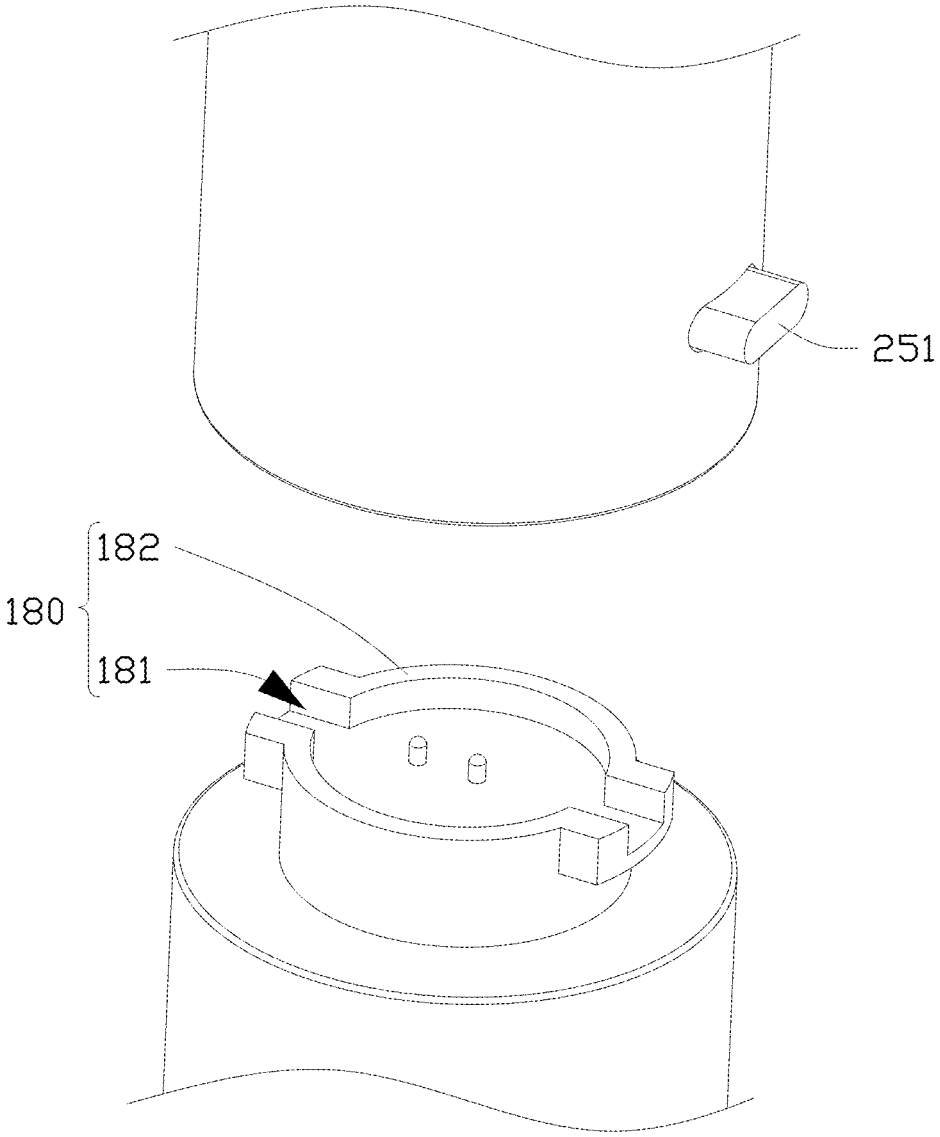
FIG. 20 is an exploded view showing another structure of the power supply assembly and the fan head of a fan according to a second embodiment of the present disclosure.
Figure 21:
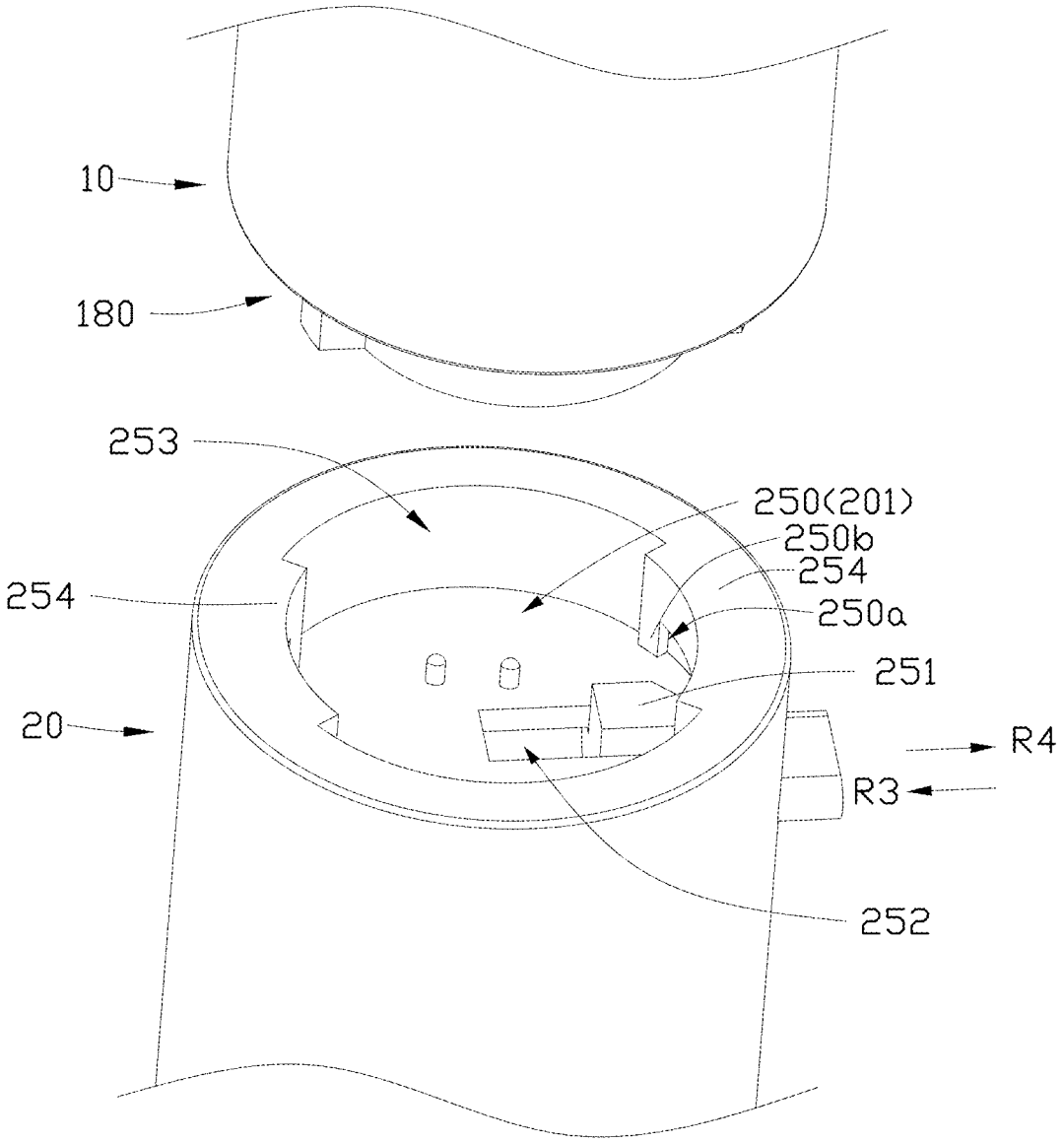
FIG. 21 is an exploded view of another structure of the power supply assembly and the fan head of the fan shown in FIG. 20 shown from another view direction.

Refer to FIG. 20 and FIG. 21, in some other embodiments, the connection structure 180 includes two limiting portions 181 and a rotating portion 182. The first engagement element 201 is a recess area 250, and a sliding block 251 is elastically sliding in a sliding slot 252. The sliding block 251 comprises a first portion and a second portion that are integrally formed, the first portion elastically slides in the sliding slot 252 and is accommodated in the recess area 250, and the second portion protrudes outward from the recess area 250 through an opening, and the opening is defined in a side wall of the recess area 250.

A side wall of the recess area 250 defines a recess opening 253 and a protrusion structure 254. The protrusion structure 254 is protruded from an inner wall of the recess area 250, and a limiting rod 250*b* is extended and protruded between the protrusion structure 254 and a bottom surface of the recess area 250. The bottom surface of the protrusion structure 254, a bottom surface of the recess opening 253 and the limiting rod 250*b* are cooperatively to define an accommodation space 250*a*. When the fan head 10 engages with the power supply assembly 20, the limiting portion 181 is aligned with the recess opening 253 and moves toward the recess opening 253 until contacting the bottom surface of the recess area 250. The limiting portion 181 is rotated along a side wall of the recess opening 253 until it is positioned within the accommodation space 250*a* under an external force. As the limiting portion 181 moves, the rotating portion 182 moves simultaneously, and the limiting portion 181 abuts against a side wall of the sliding block 251, forcing the sliding block 251 to elastically slide along the sliding groove 252 and move in a third direction R3. When the limiting portion 181 is fully received in the accommodation space 250*a*, the sliding block 251 moves in a fourth direction R4, causing the limiting rod 250*b* and the sliding block 251 to cooperatively clamp the limiting portion 181, thereby connecting the fan head 10 and the power supply assembly 20. When separating the fan head 10 from the power supply assembly 20, the sliding block 251 is pulled to move in the fourth direction R4, such that the sliding block 251 no longer abuts against the limiting portion 181. By rotating the rotating portion 182, the fan head 10 can be detached from the power supply assembly 20.

What is claimed is:

1. A fan comprising:

a fan head, configured to generate airflow, a supporting bracket configured to support the fan head on a first support surface, a power supply assembly disposed between the fan head and the supporting bracket, the power supply assembly comprising:

a housing comprising a top portion adjacent to the fan head, a bottom portion adjacent to the supporting bracket and at least one side portion connected between the top portion and the bottom portion;

a power bank received in the housing and configured to supply power to the fan head;

a first engagement element located at the top portion of the housing;

a second engagement element located at the bottom portion of the housing; and a receiving space defined in at least one of the bottom portion and the at least one side portion of the housing; and a mounting accessory configured for suspending a combination of the fan head and the power supply assembly received in the receiving space, wherein the mounting accessory is attached to the power supply assembly;

wherein the power supply assembly is electrically and mechanically connected to the fan head through the first engagement element, and is detachably engaged with the supporting bracket through the second engagement element;

the fan is operatable in a first state wherein the supporting bracket is engaged with the power supply assembly, and in a second state wherein the supporting bracket is disengaged with the power supply assembly and the mounting accessory is extracted from the receiving space; in the first state, the fan head is supported by the supporting bracket and is on the first support surface; and in the second state, the power supply assembly is suspended by the mounting accessory, such that the fan head is located below the power supply assembly, wherein the fan head assembly comprises a frame and a fan body, the frame is rotatably connected to a top end of the power supply assembly, the frame is rotatable relative to the power supply assembly in a first direction, two opposite sides of the fan body are rotatably connected to the frame, the fan body is rotatable relative to the frame along a second direction, the second direction is different from the first direction, wherein the frame comprises a connecting portion and two arms respectively connected to two opposite ends of the connecting portion, the two arms are rotatably connected to the fan body, the connecting portion and the two arms cooperatively define a space to receive the fan body, such that the fan body rotates in the space along the second direction, wherein the fan head assembly further comprises a limiting structure arranged on the frame and configured to limit a rotation angle of the fan body relative to the first support surface when the fan body rotates.

2. The fan according to claim 1, wherein the fan is further operatable in a third state wherein the supporting bracket is disengaged with the power supply assembly and the mounting accessory is received in the receiving space, and in the third state, the power supply assembly directly supports the fan head on a second support surface.

3. The fan according to claim 2, wherein the mounting accessory is a hook engaged with the housing.

4. The fan according to claim 1, wherein the supporting bracket comprises a telescopic rod and a supporting base, one end of the telescopic rod is detachably coupled to the housing, and the supporting base is engaged with another end of the telescopic rod.

5. The fan according to claim 1, wherein the supporting bracket further comprises a tripod assembly, the tripod assembly is operatable in a stowed configuration and in an extended configuration, wherein in the stowed configuration, three feet of the tripod assembly retract towards a rod of the tripod assembly and are attached to a side surface of the rod of the tripod assembly; and in the extended configuration, bottom ends of the three feet adjacent to the first support surface extend outwardly, and top ends of the three feet opposite to the bottom ends are mounted on the rod of the tripod assembly.

6. The fan according to claim 5, wherein a fixing hole is defined at the bottom ends of each foot of the tripod assembly and cooperates with a fixing element to stably mount the fan to the first support surface.

7. The fan according to claim 5, wherein a locking structure is applied between the bottom ends of each adjacent pair of feet of the three feet of the tripod assembly, the locking structure comprises a female locking element and a male locking element engaged with the female locking element, the female locking element extends from a lateral wall of the bottom end of one of the adjacent pair of feet, and the male locking element is located at a mating surface of a lateral wall of another pair of feet.

8. The fan according to claim 5, wherein the tripod assembly further comprises a locking structure configured to maintain the three feet in the stowed configuration; and a release structure configured to switch the three feet from the stowed configuration to the extended configuration, the release structure comprises a pressing member and an elastic member, the elastic member is sandwiched between the pressing member and a bottom surface of the rod, the locking structure comprises a female locking member located at the pressing member and a male locking member located at a corresponding portion of the bottom end of each foot of the three feet and is engaged with the female locking member, and when the pressing member is pressed, the elastic member is depressed thereby releasing the female locking member from the male locking member.

9. The fan according to claim 1, wherein the limiting structure comprises a gear and a first rotating shaft, the gear is fixedly arranged on the frame, the first rotating shaft comprises a first end and a second end opposite to the first end, the first end of the first rotating shaft is received in one of the two arms, and is rotatably engaged with the gear, the second end of the first rotating shaft is fixedly inserted into a side of the fan body, an elastic member protrudes from the first end of the first rotating shaft toward a direction of the gear, the elastic member is contactable with the gear, the elastic member undergoes elastic deformation and rotates with the fan body relative to the gear when the elastic member is elastically deformed; when the elastic member elastically rebounds, the elastic member elastically abuts against the gear, and the fan body remains fixed relative to the first support surface.

10. The fan according to claim 1, wherein the housing further comprises a mounting space configured to receive a fan controller, the fan controller is wirelessly connected to the fan head assembly and is configured to control the fan head assembly to turn on or turn off.

11. The fan according to claim 1, wherein a bottom end of the fan head is engaged with a first electrode pin, the first engagement element comprises a second electrode pin corresponding to the first electrode pin, and the second electrode pin is electrically connected to both the power bank and the first electrode pin when the fan head is engaged with the power supply assembly.

12. A fan, comprising:

a fan head, a power supply assembly, and a floor-standing bracket configured to support a combination of the fan head and the power supply assembly on a ground, wherein the power supply assembly is disposed between the fan head and the floor-standing bracket comprising:

a housing comprising a top portion adjacent to the fan head, a bottom portion adjacent to the floor-standing bracket and at least one side portion connected between the top portion and the bottom portion;

a power bank received in the housing and configured for supplying power to the fan head;

a first engagement element located at the top portion of the housing;

a second engagement element located at the bottom portion of the housing; and a receiving space defined in at least one of the bottom portion and the at least one side portion of the housing; and a mounting accessory configured for suspending the combination of the fan head and the power supply assembly received in the receiving space, wherein the mounting accessory is attached to the power supply assembly;

wherein the power supply assembly is mechanically connected to the fan head using the first engagement element, and is detachably engaged with the floor-standing bracket using the second engagement element;

the fan is operatable in a first state wherein the floor-standing bracket is engaged with the power supply assembly, and in a second state wherein the floor-standing bracket is disengaged with the power supply assembly and the mounting accessory is extracted from the receiving space; in the first state, the fan head is supported by the floor-standing bracket and stands on the ground; and in the second state, the power supply assembly is suspended by the mounting accessory, such that the fan head is located below the power supply assembly, wherein the fan head assembly comprises a frame and a fan body, the frame is rotatably connected to a top end of the power supply assembly, the frame is rotatable relative to the power supply assembly in a first direction, two opposite sides of the fan body are rotatably connected to the frame, the fan body is rotatable relative to the frame along a second direction, the second direction is different from the first direction, wherein the frame comprises a connecting portion and two arms respectively connected to two opposite ends of the connecting portion, the two arms are rotatably connected to the fan body, the connecting portion and the two arms cooperatively define a space to receive the fan body, such that the fan body rotates in the space along the second direction, wherein the fan head assembly further comprises a limiting structure arranged on the frame and configured to limit a rotation angle of the fan body relative to the first support surface when the fan body rotates.

13. The fan according to claim 12, wherein the fan is further operatable in a third state wherein the floor-standing bracket is disengaged with the power supply assembly and the mounting accessory is received in the receiving space, and in the third state, the power supply assembly directly supports the fan head on a second support surface.

14. The fan according to claim 12, wherein the mounting accessory includes a hook, the hook is arc-shaped and surrounds an outer periphery of the second engagement element.

15. The fan according to claim 14, wherein the hook comprises a free end and a mounted end fixedly connected to the housing, and a pivot shaft is located between the free end and the mount-mounted end; the mounted end is fixed in the receiving space, and the free end is capable of rotating relative to the mounted end via the pivot shaft and leaving from the receiving space.

16. The fan according to claim 12, wherein the first engagement element comprises a recess area and a first locking assembly, the recess area is configured for receiving a portion of the fan head, the first locking assembly is arranged at one side of the recess area and is configured for locking the fan head and the first engagement element, when the portion of the fan head is inserted into a bottom surface of the recess area, the fan head and the first engagement element are locked by the first locking assembly.

17. The fan according to claim 16, wherein the first locking assembly comprises a sliding block and a sliding slot, the sliding slot is defined on the bottom surface of the recess area; the sliding block comprises a first portion and a second portion that are integrally formed, the first portion elastically slides in the sliding slot and is accommodated in the recess area, and the second portion protrudes outward from the recess area through an opening, and the opening is defined in a side wall of the recess area, a bottom of the fan head is equipped with a rotating portion configured to contact with the bottom surface of the recess area and rotate within the recess area, a protrusion structure extends from an inner side wall at a top end of the recess area, a limiting rod is mounted between a bottom surface of the protrusion structure and the bottom surface of the recess area, and the bottom surface of the protrusion structure, the bottom surface of the recess area, and the limiting rod cooperatively define an accommodation space, with the sliding slot positioned on one side of the accommodation space, when the rotating portion rotates within the recess area and presses against the sliding block, the first portion of the sliding block slides in the sliding slot and moves outward through the opening, and the rotating portion is moved into and received in the accommodation space, the first portion of the sliding block elastically retracts, cooperating with the limiting rod to abut against both ends of the rotating portion, thereby locking the rotating portion in place.

18. A fan comprising:

a fan head, configured to generate airflow, a supporting bracket configured to support the fan head on a first support surface, a power supply assembly disposed between the fan head and the supporting bracket, the power supply assembly comprising:

a housing comprising a top portion adjacent to the fan head, a bottom portion adjacent to the supporting bracket and at least one side portion connected between the top portion and the bottom portion;

a power bank received in the housing and configured to supply power to the fan head;

a first engagement element located at the top portion of the housing;

a second engagement element located at the bottom portion of the housing; and a receiving space defined in at least one of the bottom portion and the at least one side portion of the housing; and a mounting accessory configured for suspending a combination of the fan head and the power supply assembly received in the receiving space, wherein the mounting accessory is attached to the power supply assembly;

wherein the power supply assembly is electrically and mechanically connected to the fan head through the first engagement element, and is detachably engaged with the supporting bracket through the second engagement element;

the fan is operatable in a first state wherein the supporting bracket is engaged with the power supply assembly, and in a second state wherein the supporting bracket is disengaged with the power supply assembly and the mounting accessory is extracted from the receiving space; in the first state, the fan head is supported by the supporting bracket and is on the first support surface; and in the second state, the power supply assembly is suspended by the mounting accessory, such that the fan head is located below the power supply assembly, wherein the supporting bracket further comprises a tripod assembly, the tripod assembly is operatable in a stowed configuration and in an extended configuration, wherein in the stowed configuration, three feet of the tripod assembly retract towards a rod of the tripod assembly and are attached to a side surface of the rod of the tripod assembly; and in the extended configuration, bottom ends of the three feet adjacent to the first support surface extend outwardly, and top ends of the three feet opposite to the bottom ends are mounted on the rod of the tripod assembly, wherein a locking structure is applied between the bottom ends of each adjacent pair of feet of the three feet of the tripod assembly, the locking structure comprises a female locking element and a male locking element engaged with the female locking element, the female locking element extends from a lateral wall of the bottom end of one of the adjacent pair of feet, and the male locking element is located at a mating surface of a lateral wall of another pair of feet.

* * * * *